US010007219B2

(12) United States Patent
Yamada

(10) Patent No.: US 10,007,219 B2
(45) Date of Patent: Jun. 26, 2018

(54) INSERTION DEVICE, IMAGE FORMING SYSTEM, IMAGE FORMING DEVICE, METHOD EXECUTED BY IMAGE FORMING DEVICE, AND CONTROL PROGRAM TO CONTROL IMAGE FORMING DEVICE

(71) Applicant: KONICA MINOLTA, INC., Chiyoda-ku, Tokyo (JP)

(72) Inventor: Kenichi Yamada, Higashiyamato (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 14/965,890

(22) Filed: Dec. 10, 2015

(65) Prior Publication Data

US 2016/0202651 A1 Jul. 14, 2016

(30) Foreign Application Priority Data

Jan. 9, 2015 (JP) ..... 2015-003673

(51) Int. Cl.
*G03G 15/00* (2006.01)

(52) U.S. Cl.
CPC ..... *G03G 15/50* (2013.01); *G03G 15/6502* (2013.01); *G03G 15/6511* (2013.01); *G03G 15/6564* (2013.01)

(58) Field of Classification Search
CPC ..... G03G 15/50
USPC ..... 399/382
See application file for complete search history.

(56) References Cited

U.S. PATENT DOCUMENTS 5,596,389 A * 1/1997 Dumas ..... G03G 15/655 399/16
5,839,045 A * 11/1998 Wierszewski ..... G03G 15/655 399/382
5,956,161 A * 9/1999 Takashimizu ..... H04N 1/00567 358/496
6,381,443 B1 * 4/2002 Kawata ..... B26D 7/18 270/58.07
7,088,947 B1 * 8/2006 Dobbertin ..... G03G 15/655 399/382
8,469,349 B2 * 6/2013 Maeda ..... G03G 15/655 270/58.31

(Continued)

FOREIGN PATENT DOCUMENTS

JP 2014005138 A 1/2014

*Primary Examiner* — Anthony Nguyen
(74) *Attorney, Agent, or Firm* — Holtz, Holtz & Volek PC

(57) ABSTRACT

An insertion device which inserts a second recording medium into a conveyance path to convey a plurality of first recording media fed from a feeding device includes: a loading unit in which the second recording medium is loaded; a separating unit which separates the second recording medium, which is loaded in the loading unit; a detection unit which detects time of separation of the second recording medium performed by the separating unit; a calculation unit which calculates first feed timing to feed a following first recording medium, which is conveyed in the conveyance path after the second recording medium, to the conveyance path; a notification unit which notifies the first feed timing to the feeding device; and an inserting unit which conveys the second recording medium separated by the separating unit to a converging point in the conveyance path and to insert the second recording medium into the conveyance path.

16 Claims, 22 Drawing Sheets

(56) References Cited

U.S. PATENT DOCUMENTS

| | | | | |
|---|---|---|---|---|
| 8,746,671 | B2 * | 6/2014 | Machida | B65H 7/20<br>270/58.31 |
| 2005/0042007 | A1 * | 2/2005 | Fujii | G03G 15/50<br>399/407 |
| 2006/0055766 | A1 * | 3/2006 | Kawata | G03G 15/50<br>347/164 |
| 2009/0060617 | A1 * | 3/2009 | Ogushi | B65H 31/38<br>399/407 |

* cited by examiner

FIG. 9A

| ITEM | | SIGN | TIME [ms] |
|---|---|---|---|
| CONVEYANCE INTERVAL | | T1 | 500 |
| TIME OF INSERTING INSERTION PAPER | MINIMUM TIME OF SEPARATION | T3 | 500 |
| | MAXIMUM TIME OF SEPARATION | T4 | 3000 |
| | TIME OF MAIN PAPER-FEEDING | T5 | 500 |
| CONVEYANCE TIME BEFORE CONVERGING | | T6 | 2000 |

FIG. 9B

| TIME [ms] | DEVICE | CONTENTS |
|---|---|---|
| 0 | IMAGE FORMING DEVICE | START FEEDING PRECEDING BODY PAPER OF BOOK |
| 0 | IMAGE FORMING DEVICE | TRANSMIT INSERTION REQUEST (INSERTION REQUEST FOR TWO SHEETS OF PAPER) |
| 0 | INSERTION DEVICE | START SEPARATING FIRST SHEET OF INSERTION PAPER |
| 1000 | INSERTION DEVICE | COMPLETE SEPARATING FIRST SHEET OF INSERTION PAPER ($T2_1 = 1000$) |
| 2000 | INSERTION DEVICE | PRECEDING BODY PAPER OF BOOK REACH CONVERGING POINT c ($T6 = 2000$) |
| 2500 | INSERTION DEVICE | START INSERTING FIRST SHEET OF INSERTION PAPER |
| 3000 | INSERTION DEVICE | COMPLETE INSERTING FIRST SHEET OF INSERTION PAPER |
| 3000 | INSERTION DEVICE | START SEPARATING SECOND SHEET OF INSERTION PAPER |
| 3900 | INSERTION DEVICE | COMPLETE SEPARATING SECOND SHEET OF INSERTION PAPER ($T2_2 = 900$) |
| 3900 | INSERTION DEVICE | NOTIFY FIRST FEED TIMING ($(T1+T5)*2+T2_1+T2_2 = 3900$) |
| 3900 | INSERTION DEVICE | START INSERTING SECOND SHEET OF INSERTION PAPER |
| 3900 | IMAGE FORMING DEVICE | START FEEDING FOLLOWING BODY PAPER OF BOOK |
| 4400 | INSERTION DEVICE | COMPLETE INSERTING SECOND SHEET OF INSERTION PAPER |
| 5900 | INSERTION DEVICE | FOLLOWING BODY PAPER OF BOOK REACH CONVERGING POINT c ($T6 = 2000$) |

FIG. 9C

| TIME [ms] | DEVICE | CONTENTS |
|---|---|---|
| 0 | IMAGE FORMING DEVICE | START FEEDING PRECEDING BODY PAPER OF BOOK |
| 0 | IMAGE FORMING DEVICE | TRANSMIT INSERTION REQUEST (INSERTION REQUEST FOR TWO SHEETS OF PAPER) |
| 0 | INSERTION DEVICE | NOTIFY SECOND FEED TIMING (T1*2+(T4+T5)*2=8000) |
| 0 | INSERTION DEVICE | START SEPARATING FIRST SHEET OF INSERTION PAPER |
| 1000 | INSERTION DEVICE | COMPLETE SEPARATING FIRST SHEET OF INSERTION PAPER |
| 2000 | INSERTION DEVICE | PRECEDING BODY PAPER OF BOOK REACH CONVERGING POINT c (T6=2000) |
| 2500 | INSERTION DEVICE | START INSERTING FIRST SHEET OF INSERTION PAPER |
| 3000 | INSERTION DEVICE | COMPLETE INSERTING FIRST SHEET OF INSERTION PAPER |
| 3000 | INSERTION DEVICE | START SEPARATING SECOND SHEET OF INSERTION PAPER |
| 3900 | INSERTION DEVICE | COMPLETE SEPARATING SECOND SHEET OF INSERTION PAPER |
| 3900 | INSERTION DEVICE | START INSERTING SECOND SHEET OF INSERTION PAPER |
| 4400 | INSERTION DEVICE | COMPLETE INSERTING SECOND SHEET OF INSERTION PAPER |
| 8000 | IMAGE FORMING DEVICE | START FEEDING FOLLOWING BODY PAPER OF BOOK |
| 10000 | INSERTION DEVICE | FOLLOWING BODY PAPER OF BOOK REACH CONVERGING POINT c (T6=2000) |

FIG. 12A

| ITEM | | SIGN | TIME [ms] |
|---|---|---|---|
| CONVEYANCE INTERVAL | | T1 | 500 |
| TIME OF INSERTING INSERTION PAPER | MINIMUM TIME OF SEPARATION | T3 | 1500 |
| | MAXIMUM TIME OF SEPARATION | T4 | 3000 |
| | TIME OF MAIN PAPER-FEEDING | T5 | 500 |
| CONVEYANCE TIME BEFORE CONVERGING | | T6 | 6000 |

FIG. 12B

| TIME [ms] | DEVICE | CONTENTS |
|---|---|---|
| 0 | IMAGE FORMING DEVICE | START FEEDING PRECEDING BODY PAPER OF BOOK |
| 0 | IMAGE FORMING DEVICE | TRANSMIT INSERTION REQUEST (INSERTION REQUEST FOR TWO SHEETS OF PAPER) |
| 0 | INSERTION DEVICE | NOTIFY SECOND FEED TIMING ($T1*2+(T4+T5)*2=8000$) |
| 0 | INSERTION DEVICE | START SEPARATING FIRST SHEET OF INSERTION PAPER |
| 1500 | INSERTION DEVICE | COMPLETE SEPARATING FIRST SHEET OF INSERTION PAPER ($T2_1=1500$) |
| 6000 | INSERTION DEVICE | PRECEDING BODY PAPER OF BOOK REACH CONVERGING POINT c ($T6=6000$) |
| 6500 | INSERTION DEVICE | START INSERTING FIRST SHEET OF INSERTION PAPER |
| 7000 | INSERTION DEVICE | COMPLETE INSERTING FIRST SHEET OF INSERTION PAPER |
| 7000 | INSERTION DEVICE | START SEPARATING SECOND SHEET OF INSERTION PAPER |
| 8000 | IMAGE FORMING DEVICE | START FEEDING FOLLOWING BODY PAPER OF BOOK |
| 8500 | INSERTION DEVICE | COMPLETE SEPARATING SECOND SHEET OF INSERTION PAPER ($T2_2=1500$) |
| 8500 | INSERTION DEVICE | NOTIFY FIRST FEED TIMING ($(T1+T5)*2+T2_1+T2_2=5000$) |
| 8500 | INSERTION DEVICE | START INSERTING SECOND SHEET OF INSERTION PAPER |
| 9000 | INSERTION DEVICE | COMPLETE INSERTING SECOND SHEET OF INSERTION PAPER |
| 14000 | INSERTION DEVICE | FOLLOWING BODY PAPER OF BOOK REACH CONVERGING POINT c ($T6=6000$) |

FIG. 12C

| TIME [ms] | DEVICE | CONTENTS |
|---|---|---|
| 0 | IMAGE FORMING DEVICE | START FEEDING PRECEDING BODY PAPER OF BOOK |
| 0 | IMAGE FORMING DEVICE | TRANSMIT INSERTION REQUEST (INSERTION REQUEST FOR TWO SHEETS OF PAPER) |
| 0 | INSERTION DEVICE | START SEPARATING FIRST SHEET OF INSERTION PAPER |
| 1500 | INSERTION DEVICE | COMPLETE SEPARATING FIRST SHEET OF INSERTION PAPER ($T2_1 = 1500$) |
| 6000 | INSERTION DEVICE | PRECEDING BODY PAPER OF BOOK REACH CONVERGING POINT c ($T6 = 6000$) |
| 6500 | INSERTION DEVICE | START INSERTING FIRST SHEET OF INSERTION PAPER |
| 7000 | INSERTION DEVICE | COMPLETE INSERTING FIRST SHEET OF INSERTION PAPER |
| 7000 | INSERTION DEVICE | START SEPARATING SECOND SHEET OF INSERTION PAPER |
| 8500 | INSERTION DEVICE | COMPLETE SEPARATING SECOND SHEET OF INSERTION PAPER ($T2_2 = 1500$) |
| 8500 | INSERTION DEVICE | NOTIFY FIRST FEED TIMING ($(T1 + T5) * 2 + T2_1 + T2_2 = 5000$) |
| 8500 | IMAGE FORMING DEVICE | START FEEDING FOLLOWING BODY PAPER OF BOOK |
| 8500 | INSERTION DEVICE | START INSERTING SECOND SHEET OF INSERTION PAPER |
| 9000 | INSERTION DEVICE | COMPLETE INSERTING SECOND SHEET OF INSERTION PAPER |
| 14500 | INSERTION DEVICE | FOLLOWING BODY PAPER OF BOOK REACH CONVERGING POINT c ($T6 = 6000$) |

FIG. 17A

| ITEM | | SIGN | TIME [ms] |
|---|---|---|---|
| CONVEYANCE INTERVAL | | T1 | 500 |
| TIME OF INSERTING INSERTION PAPER | MINIMUM TIME OF SEPARATION | T3 | 500 |
| | MAXIMUM TIME OF SEPARATION | T4 | 3000 |
| | TIME OF MAIN PAPER-FEEDING | T5 | 500 |
| CONVEYANCE TIME BEFORE CONVERGING | | T6 | 2000 |

FIG. 17B

| TIME [ms] | DEVICE | CONTENTS |
|---|---|---|
| 0 | IMAGE FORMING DEVICE | START FEEDING PRECEDING BODY PAPER OF BOOK |
| 0 | IMAGE FORMING DEVICE | TRANSMIT INSERTION REQUEST (INSERTION REQUEST FOR TWO SHEETS OF PAPER) |
| 0 | INSERTION DEVICE | START SEPARATING FIRST SHEET OF INSERTION PAPER |
| 1000 | INSERTION DEVICE | COMPLETE SEPARATING FIRST SHEET OF INSERTION PAPER ($T2_1 = 1000$) |
| 2000 | INSERTION DEVICE | PRECEDING BODY PAPER OF BOOK REACH CONVERGING POINT c ($T6 = 2000$) |
| 2500 | INSERTION DEVICE | START INSERTING FIRST SHEET OF INSERTION PAPER |
| 3000 | INSERTION DEVICE | COMPLETE INSERTING FIRST SHEET OF INSERTION PAPER |
| 3000 | INSERTION DEVICE | START SEPARATING SECOND SHEET OF INSERTION PAPER |
| 3900 | INSERTION DEVICE | COMPLETE SEPARATING SECOND SHEET OF INSERTION PAPER ($T2_2 = 900$) |
| 3900 | INSERTION DEVICE | NOTIFY FIRST FEED TIMING ($(T1 + T5) * 2 + T2_1 + T2_2 = 3900$) |
| 3900 | INSERTION DEVICE | START INSERTING SECOND SHEET OF INSERTION PAPER |
| 4400 | INSERTION DEVICE | COMPLETE INSERTING SECOND SHEET OF INSERTION PAPER |
| 5800 | IMAGE FORMING DEVICE | START FEEDING FOLLOWING BODY PAPER OF BOOK |
| 7800 | INSERTION DEVICE | FOLLOWING BODY PAPER OF BOOK REACH CONVERGING POINT c ($T6 = 2000$) |

FIG. 17C

| TIME [ms] | DEVICE | CONTENTS |
|---|---|---|
| 0 | IMAGE FORMING DEVICE | START FEEDING PRECEDING BODY PAPER OF BOOK |
| 0 | IMAGE FORMING DEVICE | TRANSMIT INSERTION REQUEST (INSERTION REQUEST FOR TWO SHEETS OF PAPER) |
| 0 | INSERTION DEVICE | START SEPARATING FIRST SHEET OF INSERTION PAPER |
| 1000 | INSERTION DEVICE | COMPLETE SEPARATING FIRST SHEET OF INSERTION PAPER ($T2_1 = 1000$) |
| 2000 | INSERTION DEVICE | PRECEDING BODY PAPER OF BOOK REACH CONVERGING POINT c (T6 = 2000) |
| 2500 | INSERTION DEVICE | START INSERTING FIRST SHEET OF INSERTION PAPER |
| 3000 | INSERTION DEVICE | COMPLETE INSERTING FIRST SHEET OF INSERTION PAPER |
| 3000 | INSERTION DEVICE | START SEPARATING SECOND SHEET OF INSERTION PAPER |
| 3900 | INSERTION DEVICE | COMPLETE SEPARATING SECOND SHEET OF INSERTION PAPER ($T2_2 = 900$) |
| 3900 | INSERTION DEVICE | NOTIFY FIRST FEED TIMING ($(T1 + T5) * 2 + T2_1 + T2_2 = 3900$) |
| 3900 | INSERTION DEVICE | START INSERTING SECOND SHEET OF INSERTION PAPER |
| 4400 | INSERTION DEVICE | COMPLETE INSERTING SECOND SHEET OF INSERTION PAPER |
| 7800 | IMAGE FORMING DEVICE | START FEEDING FOLLOWING BODY PAPER OF BOOK |
| 9800 | INSERTION DEVICE | FOLLOWING BODY PAPER OF BOOK REACH CONVERGING POINT c (T6 = 2000) |

INSERTION DEVICE, IMAGE FORMING SYSTEM, IMAGE FORMING DEVICE, METHOD EXECUTED BY IMAGE FORMING DEVICE, AND CONTROL PROGRAM TO CONTROL IMAGE FORMING DEVICE

The entire disclosure of Japanese Patent Application No. 2015-003673 filed on Jan. 9, 2015 including description, claims, drawings, and abstract are incorporated herein by reference in its entirety.

BACKGROUND OF THE INVENTION

Field of the Invention

The present invention relates to an insertion device, an image forming system including the insertion device, an image forming device including an insertion function, a method executed by the image forming device, and a control program to control the image forming device.

Description of the Related Art

By connecting a post-processing device to an image forming device, it becomes possible to perform various kinds of post-processing such as folding, punching, binding, cutting, and insertion with respect to a recording medium on which an image is formed.

For example, in insertion processing, a recording medium such as cardboard or colored paper (hereinafter, also referred to as second recording medium) is inserted into a flow of conveyance of a plurality of recording media on which images are formed (hereinafter, also referred to as first recording medium).

As such a technology, in JP 2014-5138 A, a conveyance system including a conveyance device to form an image on a first recording medium and an insertion device to insert a second recording medium between a plurality of first recording media on which images are formed is disclosed.

In the conveyance system of JP 2014-5138 A, the insertion device calculates insertion preparation time based on time necessary until the second recording medium housed in the insertion device is converged to a conveyance path where the first recording medium is conveyed. Then, in consideration of timing at which insertion of the second recording medium is completed, the conveyance device determines, based on the insertion preparation time, paper-feed timing of the first recording medium which feeding follows the insertion of the second recording medium.

Thus, according to the conveyance system of JP 2014-5138 A, the first recording medium which follows the second recording medium does not collide with the second recording medium. Moreover, according to the conveyance system of JP 2014-5138 A, the first recording medium can be fed before insertion of the second recording medium is completed as long as collision with the second recording medium is not caused at the timing. Accordingly, productivity can be improved.

However, in the above conveyance system, the conveyance device determines paper-feed timing of a following first recording medium based on the insertion preparation time calculated before the second recording medium is conveyed. Since the insertion preparation time is previously calculated, it is necessary to calculate the insertion preparation time in consideration of the longest time (hereinafter, also referred to as maximum time) on the assumption of various cases. For example, when conveyance of the second recording medium is started in the insertion device, first, it is necessary to separate one second recording medium from a tray in which a plurality of second recording media is housed. Thus, due to a variation in the number of second recording media loaded in the tray or a degree of abrasion of a separation mechanism such as a separating roller to separate a second recording medium from the tray, separation time of the second recording medium varies. Thus, in the conveyance system, it is necessary to calculate the insertion preparation time according to the maximum value of the separation time.

In such a manner, when the insertion preparation time is calculated in consideration of the maximum time, paper-feed timing of a following first recording medium is delayed due to the maximum value of the separation time even in a case where actual separation does not take much time. Thus, productivity is decreased. The present invention has been made to solve the above problem.

SUMMARY OF THE INVENTION

An object of the present invention is to provide an insertion device which can improve productivity in a case of inserting a second recording medium between a plurality of first recording media, an image forming system, an image forming device, a method executed by the image forming device, and a control program to control the image forming device.

(1) To achieve the abovementioned object, according to an aspect, an insertion device which can insert a second recording medium into a conveyance path to convey a plurality of first recording media fed from a feeding device, the insertion device reflecting one aspect of the present invention comprises: a loading unit in which the second recording medium is loaded; a separating unit configured to separate the second recording medium, which is loaded in the loading unit, one by one according to an insertion request from the feeding device; a detection unit configured to detect time of separation of the second recording medium performed by the separating unit; a calculation unit configured to calculate first feed timing to feed a following first recording medium, which is conveyed in the conveyance path after the second recording medium, to the conveyance path based on the separation time detected by the detection unit; a notification unit configured to notify the first feed timing to the feeding device; and an inserting unit configured to convey the second recording medium separated by the separating unit to a converging point in the conveyance path and to insert the second recording medium into the conveyance path.

(2) The insertion device according to Item. 1, wherein when receiving the insertion request, the calculation unit further preferably calculates second feed timing to feed the following first recording medium to the conveyance path based on maximum time which is necessary to separate the second recording medium with the separating unit and time elapsed until the second recording medium is inserted by the inserting unit, and the notification unit further preferably notifies the second feed timing to the feeding device.

(3) To achieve the abovementioned object, according to an aspect, an image forming system reflecting one aspect of the present invention comprises: an image forming device configured to form an image on a plurality of first recording media; a conveyance path configured to convey the first recording media fed from the image forming device; and an insertion device configured to insert a second recording medium into the conveyance path, wherein the insertion device includes a loading unit in which the second recording medium is loaded, a separating unit configured to separate the second recording medium, which is loaded in the loading unit, one by one according to an insertion request from the image forming device, a detection unit configured to detect time of separation of the second recording medium performed by the separating unit, a calculation unit configured to calculate first feed timing to feed a following first recording medium, which is conveyed in the conveyance path after the second recording medium, to the conveyance path based on the separation time detected by the detection unit, a notification unit configured to notify the first feed timing to the image forming device, and an inserting unit configured to convey the second recording medium separated by the separating unit to a converging point in the conveyance path and to insert the second recording medium into the conveyance path, and the image forming device includes an image forming unit configured to form an image on the first recording media, and a control unit configured to feed the following first recording medium to the conveyance path based on the first feed timing.

(4) The image forming system according to Item. 3, wherein the image forming device further preferably includes a measuring unit configured to measure time elapsed from a time point at which a preceding first recording medium conveyed in the conveyance path before the second recording medium to be inserted is fed to the conveyance path, and the control unit feeds the following first recording medium to the conveyance path at the first feed timing when the elapsed time does not reach the first feed timing at a time point at which the first feed timing is received from the notification unit, and immediately feeds the following first recording medium to the conveyance path when the elapsed time exceeds the first feed timing.

(5) The image forming system according to Item. 4, wherein when receiving the insertion request, the calculation unit further preferably calculates second feed timing to feed the following first recording medium to the conveyance path based on maximum time which is necessary for the separating unit to separate the recording medium and time elapsed until the recording medium is inserted by the inserting unit, the notification unit further preferably notifies the second feed timing to the image forming device, and when the elapsed time reaches the second feed timing before the first feed timing is received from the notification unit, the control unit preferably feeds the following first recording medium to the conveyance path.

(6) The image forming system according to any one of Items. 3 to 5, wherein the control unit preferably receives the feed timing from the notification unit as a conveyance time interval between a time point at which a preceding first recording medium conveyed in the conveyance path before the second recording medium to be inserted is fed to the conveyance path and a time point at which the following first recording medium is fed to the conveyance path.

(7) The image forming system according to any one of Items. 3 to 5, wherein the control unit preferably receives the feed timing from the notification unit as a conveyance time interval between a time point at which the feed timing is received from the notification unit and a time point at which the following first recording medium is fed to the conveyance path.

(8) The image forming system according to Item. 7, wherein the notification unit preferably notifies the feed timing to the image forming device at later one of a time point at which the separating unit completes separating the second recording medium to be inserted and a time point at which the preceding first recording medium conveyed in the conveyance path before the second recording medium to be inserted is conveyed to the converging point.

(9) To achieve the abovementioned object, according to an aspect, an image forming device reflecting one aspect of the present invention comprises: an image forming unit configured to form an image on a plurality of first recording media based on a print job related to image-forming on the plurality of first recording media and insertion of a second recording medium; a conveyance path configured to convey the first recording media fed from the image forming unit; a loading unit which is provided in a downstream in a conveyance direction of the image forming unit in the conveyance path and in which the second recording medium is loaded; a separating unit configured to separate the second recording medium, which is loaded in the loading unit, one by one based on the print job; a detection unit configured to detect time of separation of the second recording medium performed by the separating unit; a calculation unit configured to calculate first feed timing to feed a following first recording medium, which is conveyed in the conveyance path after the second recording medium, to the conveyance path based on the separation time detected by the detection unit; a control unit configured to feed the following first recording medium to the conveyance path based on the first feed timing calculated by the calculation unit; and an inserting unit configured to convey the second recording medium separated by the separating unit to a converging point in the conveyance path and to insert the second recording medium into the conveyance path.

(10) To achieve the abovementioned object, according to an aspect, a method executed by an image forming device reflecting one aspect of the present invention comprises: a step (a) of forming an image on a plurality of first recording media with an image forming unit based on a print job related to image-forming on the plurality of first recording media and insertion of a second recording medium; a step (b) of separating, based on the print job, the second recording medium one by one from a loading unit, in which the second recording medium is loaded, with a separating unit which is provided in a downstream in a conveyance direction of the image forming unit in a conveyance path to convey the first recording media fed from the image forming unit; a step (c) of detecting separation time of the second recording medium with a detection unit; a step (d) of calculating first feed timing, which is timing to feed a following first recording medium conveyed in the conveyance path after the second recording medium to the conveyance path, with the calculation unit based on the detected separation time; a step (e) of feeding the following first recording medium to the conveyance path with the control unit based on the calculated first feed timing; and a step (f) of conveying the second recording medium separated by the separating unit to a converging point in the conveyance path and inserting the second recording medium into the conveyance path with the inserting unit.

(11) To achieve the abovementioned object, according to an aspect, a non-transitory recording medium storing a computer readable control program to control an image forming device, the program reflecting one aspect of the present invention causes a computer to execute a procedure (A) to form an image on a plurality of first recording media with an image forming unit based on a print job related to image-forming on the plurality of first recording media and insertion of a second recording medium, a procedure (B) to separate, based on the print job, the second recording medium one by one from a loading unit, in which the second recording medium is loaded, with a separating unit which is provided in a downstream in a conveyance direction of the image forming unit in a conveyance path to convey the first recording media fed from the image forming unit, a procedure (C) to detect separation time of the second recording medium with a detection unit, a procedure (D) to calculate first feed timing, which is timing to feed a following first recording medium conveyed in the conveyance path after the second recording medium to the conveyance path, with the calculation unit based on the detected separation time, a procedure (E) to feed the following first recording medium to the conveyance path with the control unit based on the calculated first feed timing, and a procedure (F) to convey the second recording medium separated by the separating unit to a converging point in the conveyance path and to insert the second recording medium into the conveyance path with the inserting unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIGS. 9A to 9C are charts illustrating examples of insertion of insertion paper performed by an image forming system according to the first embodiment;

FIGS. 12A to 12C are charts illustrating examples of insertion of insertion paper performed by an image forming system according to the second embodiment;

FIGS. 17A to 17C are charts illustrating examples of insertion of insertion paper performed by an image forming system according to the first modification example.

DESCRIPTION OF THE PREFERRED EMBODIMENTS

Hereinafter, an embodiment of the present invention will be described with reference to the drawings. However, the scope of the invention is not limited to the illustrated examples. Note that the same sign is assigned to identical elements in a description of the drawings and an overlapped description is omitted. Further, a dimensional proportion of the drawings is exaggerated for convenience of description and may be different from an actual proportion.

First Embodiment (Configuration of Image Forming System)

Figure 1:
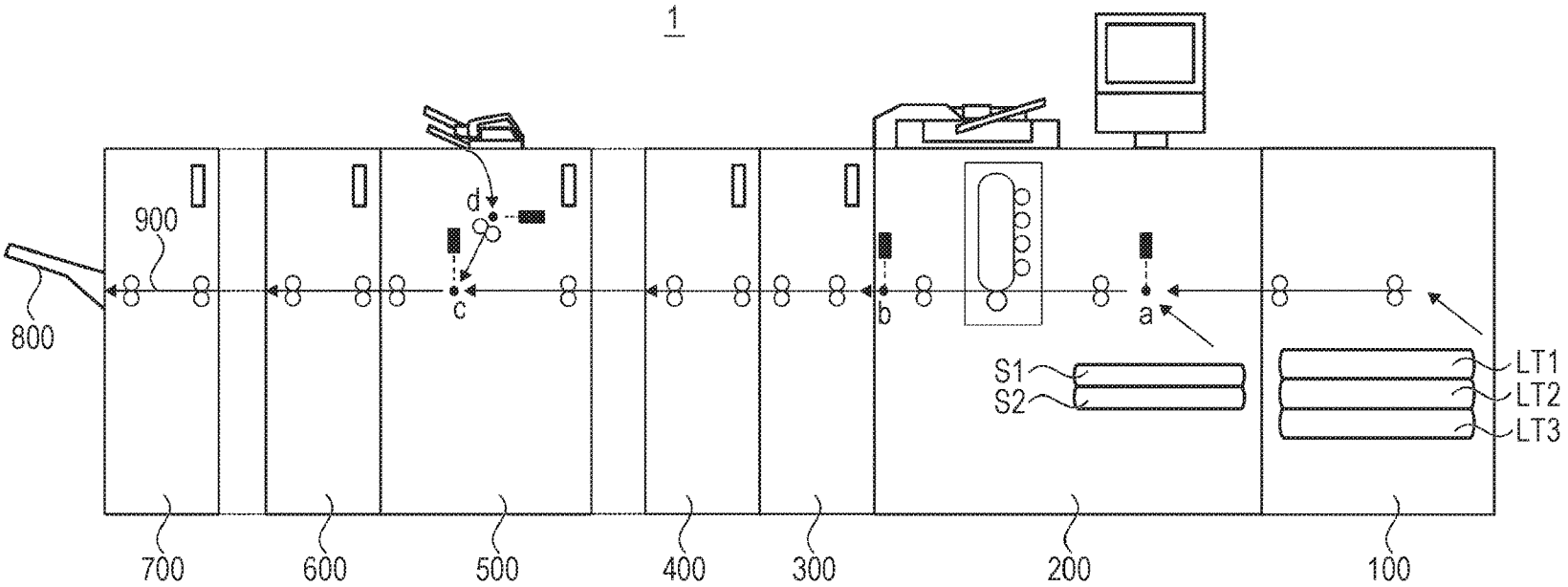
FIG. 1 is a view illustrating an example of a schematic configuration of an image forming system.

FIG. 1 is a view illustrating an example of a schematic configuration of the image forming system.

As illustrated in FIG. 1, an image forming system 1 includes a large-capacity paper feed tray 100, an image forming device 200, a plurality of post-processing devices 300 to 700, and a collection tray 800. The large-capacity paper feed tray 100, the image forming device 200, the plurality of post-processing devices 300 to 700, and the collection tray 800 are connected to each other in order and configure, in an entire length of the system, a conveyance path 900 to convey a recording medium such as paper.

The image forming system 1 serially conveys a plurality of recording media to the conveyance path 900 and performs various kinds of processing, whereby a final printed material such as a booklet can be acquired.

The large-capacity paper feed tray 100 feeds a recording medium to the conveyance path 900. The large-capacity paper feed tray 100 includes, for example, three paper cassettes LT1, LT2, and LT3. Recording media with different sizes or materials may be respectively housed in the cassettes. In the following, a recording medium (first recording medium) fed from the large-capacity paper feed tray 100 is called body paper of a book. Note that there may be a plurality of large-capacity paper feed trays 100.

The image forming device 200 forms an image on body paper of a book which paper is fed from the large-capacity paper feed tray 100. However, this is not the limitation. For example, the image forming device 200 may form an image on body paper of a book which paper is fed from a paper feed tray S1 or S2 embedded in the image forming device 200. Compared to the large-capacity paper feed tray 100, each of the paper feed trays S1 and S2 houses less body paper of a book. The body paper of a book housed in each of the paper feed trays S1 and S2 is fed to the conveyance path 900 at a point a illustrated in FIG. 1 (hereinafter, also referred to as feed point a). The body paper of a book on which paper an image is formed is ejected from the image forming device 200 at a point b illustrated in FIG. 1 (hereinafter, also referred to as electing point b) and is fed to the post-processing devices 300 to 700. A detailed configuration or function of the image forming device 200 will be described later.

The plurality of post-processing devices 300 to 700 perform various kinds of post-processing (such as folding, punching, binding, cutting, insertion, stapling, and stacking) with respect to the body paper of a book which paper is fed from the image forming device 200. In the present embodiment, at least one of the post-processing devices 300 to 700 performs insertion as post-processing. For example, the post-processing device 500 inserts a recording medium different from the body paper of a book into the conveyance path 900 at a point c (hereinafter, also referred to as converging point c) on the conveyance path 900 illustrated in FIG. 1. In the following, the post-processing device 500 is referred to as an insertion device 500. Further, in the following, a recording medium (second recording medium) inserted from the insertion device 500 is called insertion paper. A detailed configuration or function of the insertion device 500 will be described later.

Note that it is possible to change order of connection of the post-processing devices 300 to 700 and to change the number of connected devices when necessary.

The collection tray 800 collects body paper of a book and insertion paper which are conveyed in the conveyance path 900.

The image forming system 1 configured in the above manner forms images on a plurality of sheets of body paper of a book with the image forming device 200 and inserts, with the insertion device 500, insertion paper into the conveyance path 900 to convey the plurality of sheets of body paper of a book on each sheet of which an image is formed.

In the following, the image forming device 200 and the insertion device 500 will be described in more detail.

Configuration of Image Forming Device 200

Figure 2:
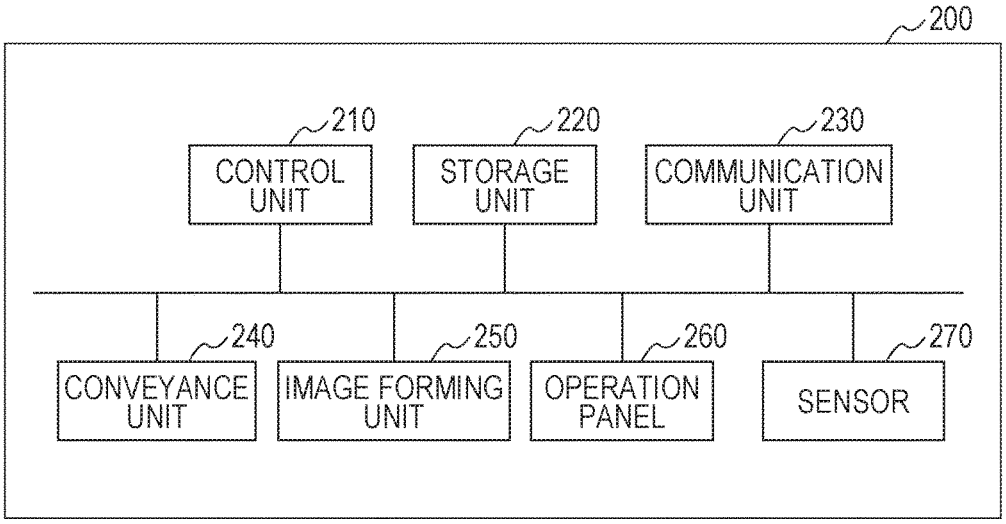
FIG. 2 is a block diagram illustrating an example of a hardware configuration of an image forming device.

FIG. 2 is a block diagram illustrating an example of a hardware configuration of the image forming device 200. As illustrated in FIG. 2, the image forming device 200 includes a control unit 210, a storage unit 220, a communication unit 230, a conveyance unit 240, an image forming unit 250, an operation panel 260, and a sensor 270 which are connected to each other through a bus to exchange a signal.

The control unit 210 is, for example, a central processing unit (CPU) and executes control or each of the configuration elements and various kinds of calculation processing according to a program.

The storage unit 220 includes a read only memory (ROM) to previously store various programs or various kinds of data, a random access memory (RAM) to temporarily store, as a work area, a program or data, a hard disk to store various programs or various kinds of data, and the like.

The communication unit 230 is an interface to communicate with a different device (such as host device or post-processing device) through a network. For communication, a standard such as Ethernet (registered trademark), Wi-Fi, FDDI or Token Ring is used.

The conveyance unit 240 conveys, to the image forming unit 250, the body paper of a book which paper is fed from the large-capacity paper feed tray 100 or the paper feed tray S1 or S2. Further, the conveyance unit 240 feeds, to the post-processing devices 300 to 700, the body paper of a book on which paper an image is formed by the image forming unit 250.

The image forming unit 250 forms an image which is based on various kinds of data onto the body paper of a book by using a known imaging process such as an electrophotographic process including steps of electrification, exposure, development, transfer, and fixing.

The operation panel 260 includes a touch panel, a numeric keypad, a start button, a stop button, and the like and is used for a display of various kinds of information and for an input of various instructions.

The sensor 270 is, for example, a plurality of optical sensors provided in necessary places on the conveyance path 900. In a provided place, for example, each sensor 270 detects that there is body paper of a book in the conveyance path 900 and notifies the detection result to the control unit 210. For example, each sensor 270 notifies, to the control unit. 210, a leading end of the body paper of a book reaches the feed point a or the ejecting point b illustrated in FIG. 1.

For example, when receiving a print job from a host device in which a printer driver (not illustrated) is embedded, the control unit 210 controls conveyance of the body paper of a book in the image forming device 200 by controlling the conveyance unit 240. For example, the control unit 210 can control a conveyance interval (hereinafter also referred to as paper distance) of following body paper of a book. The paper distance is determined according to processing capacity of a post-processing device.

Further, when the received print job includes a post-processing request, the control unit 210 transmits the post-processing request to a corresponding post-processing device and receives various kinds of information from the post-processing device. For example, in a case of receiving a print job including an insertion request, the control unit 210 transmits the insertion request to the insertion device 500 when preceding body paper of a book (preceding first recording medium), which paper is conveyed to the conveyance path 900 before insertion paper, passes through the feed point a or the ejecting point b illustrated in FIG. 1. Then, the control unit 210 receives feed timing to feed, to the conveyance path 900, the following body paper of a book (following first recording medium) which paper is conveyed from the insertion device 500 to the conveyance path 900 after the insertion paper used on the feed timing received from the insertion device 500, the control unit 210 feeds the following body paper of a book to the conveyance path 900. Moreover, the control unit 210 measures, as a measuring unit, elapsed time from a time point at which the body paper of a book passes through the feed point a or the ejecting point b.

Configuration of Insertion Device 500

Figure 3:
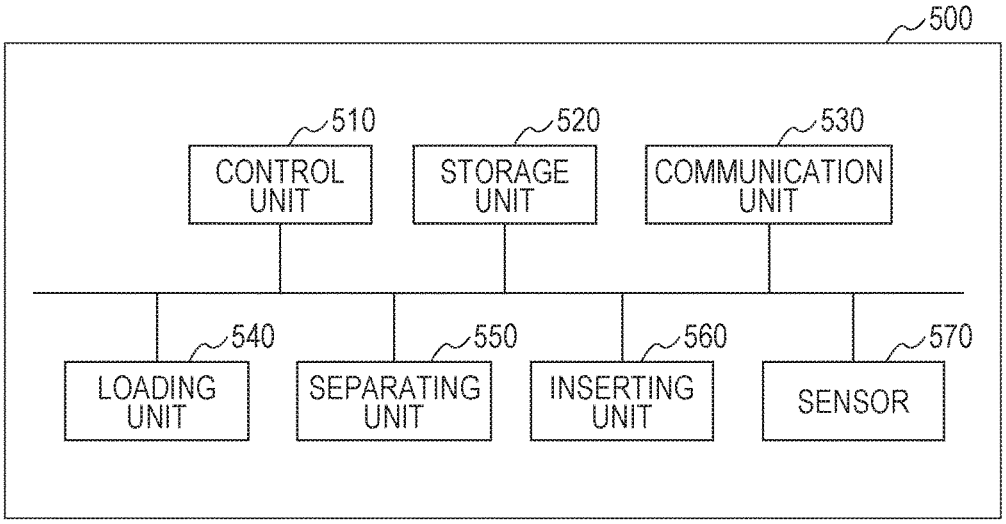
FIG. 3 is a block diagram illustrating an example of a hardware configuration of an insertion device.

FIG. 3 is a block diagram illustrating an example of a hardware configuration of the insertion device 500. As illustrated in FIG. 3, the insertion device 500 includes a control unit 510, a storage unit 520, a communication unit 530, a loading unit 540, a separating unit 550, an inserting unit 560, and a sensor 570 which are connected to each other through a bus to exchange a signal. Note that since the storage unit. 520, the communication unit 530, and the sensor 570 respectively include functions similar to those of the storage unit 220, the communication unit 230, and the sensor 270 of the image forming device 200, a description thereof is omitted to avoid an overlapped description.

The control unit 510 executes control of each of the configuration elements or various kinds of calculation processing according to a program. Based on an instruction from the image forming device 200, the control unit 510 controls the separating unit 550 and the inserting unit 560 and inserts insertion paper into the conveyance path 900.

In the loading unit 540, insertion paper is loaded. The loading unit. 540 includes, for example, two loading trays W1 and W2. Sheets of insertion paper with different sizes or materials may be respectively loaded in the loading trays. Note that the insertion paper may be a recording medium identical to the body paper of a book or a recording medium different therefrom.

The separating unit 550 separates sheets of insertion paper, which is loaded in the loading unit 540, one by one. Further, the separating unit 550 conveys the separated second recording medium to a point d illustrated in FIG. 1. Note that the separated insertion paper can temporarily wait at the point d. Processing of separating insertion paper and conveying the insertion paper to the point d at which waiting can be performed is also referred to as "pre-paper-feeding" and the point d at which waiting can be performed is also referred to as a "pre-paper-feeding point." Further, the separating unit 550 does not separate new sheet of insertion paper until the separated insertion paper is inserted into the conveyance path 900. The separating unit 550 may be, for example, a separating roller.

The inserting unit 560 conveys the insertion paper from the pre-paper-feeding point d to the converging point and inserts the paper into the conveyance path 900. Processing of conveying the insertion paper from the pre-paper-feeding point d to the converging point c is also referred to as "main paper-feeding" and the converging point c is also referred to as a "main paper-feeding point." For example, the inserting unit 560 includes one pair of nip conveyance rollers. When being inserted into the conveyance path 900, the insertion paper is ejected from the insertion device 500 along with a plurality of sheets of body paper of a book.

When receiving an insertion request from the image forming device 200, the control unit 510 separates one sheet of insert on paper from the loading unit 540 by controlling the separating unit 550 and inserts the separated insertion paper into the conveyance path 900 by controlling the inserting unit 560. Further, in a case of successively inserting a plurality of sheets of insertion paper into the conveyance path 900, the control unit 510 does not stop the second and following sheets of insertion paper in the pre-paper-feeding and continuously perform the main paper-feeding by controlling the separating unit 550 and the inserting unit 560.

Further, the control unit 510 detects, as a detection unit, a time interval from a time point at which the separating unit 550 starts separating the insertion paper to a time point at which the sensor 570 detects that a leading end of the insertion paper reaches the pre-paper-feeding point d, the interval being detected as separation time of the insertion paper.

Moreover, as a calculation unit, the control unit 510 calculates, based on the detected separation time, first feed timing at which following body paper of a book is fed to the conveyance path 900.

Further, as a notification unit, the control unit 510 transmits the first feed timing which is calculated based on the separation time of the insertion paper to the image forming device 200.

Next, a state in which the insertion device 500 inserts insertion paper into body paper of a book conveyed in the conveyance path 900 will be described.

State of Insertion of Insertion Paper

Figure 4:
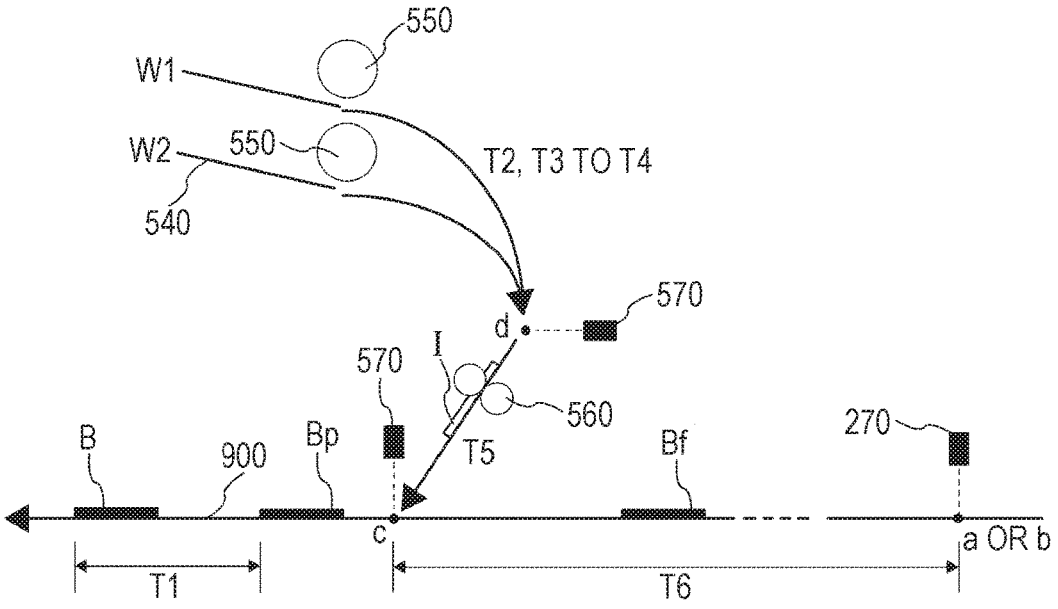
FIG. 4 is a view illustrating a state in which insertion paper is inserted into a conveyance path by the insertion device.

FIG. 4 is a view illustrating a state in which insertion paper is inserted into a conveyance path 900 by the insertion device 500.

In an example in FIG. 4, a state in which one sheet of insertion paper is inserted into the body paper of a book is illustrated. In FIG. 4, B indicates body paper of a book and I indicates insertion paper. Specifically, among the body paper of a book B, preceding body paper of a book which is conveyed before the insertion paper I is indicated by Bp and following body paper of a book conveyed after the insertion paper I is indicated by Bf. Further, in FIG. 4, time necessary for various operations or various kinds of processing is indicated by Tn.

First, a definition of the time Tn will be described before a state of inserting the insertion paper is described in detail.

T1 is a conveyance interval (time) of paper which interval is determined according to processing capacity of each of the post-processing devices 300 to 700 or a size of the paper. For example, when the body paper of a book B is successively fed to the conveyance path 900, the body paper of a book B is conveyed at the conveyance interval T1. However, as described in the present embodiment, in a case where the insertion paper I is inserted, it is not possible to set the conveyance interval T1 as a time interval between the insertion paper I and the following body paper of a book Bf. The conveyance interval T1 is previously stored in the storage unit 520.

T2 is time spent by the separating unit 550 to separate the insertion paper I. The separation time is time spent after the separating unit 550 starts performing a separating operation and until the sensor 570 detects that a leading end of the detection insertion paper I reaches the pre-paper-feeding point d. The separation time varies greatly according to a change in a kind or the number of sheets of insertion paper I loaded in the loading unit 540 or a lifetime of the separating unit 550 to separate the insertion paper I from the loading unit 540 (such as degree of abrasion of separating roller). Thus, actually-measured 12 has a value between the minimum time T3 and the maximum time 14 which may be necessary for separation. The control unit 510 detects the separation time T2 of the insertion paper I each time the insertion paper I is separated. The minimum time T3 and the maximum time T4 are previously stored in the storage unit 520.

T5 is time necessary for the main paper-feeding of the insertion paper I performed by the inserting unit 560 (main paper-feeding time). Since the inserting unit 560 nips and conveys the insertion paper I with the pair of nip conveyance rollers, the main paper-feeding time T5 of the insertion paper I rarely varies. The main paper-feeding time T5 is previously stored in the storage unit 520.

T6 is conveyance time of the body paper of a book from the feed point a to the converging point c (conveyance time before converging). However, this is not the limitation and T6 may be conveyance time of the body paper of a book from the ejecting point b to the converging point c. Note that unlike the present embodiment, when the insertion device 500 is coupled immediately behind the image forming device 200 and the ejecting point b overlaps with the converging point c, there is a case where a value of T6 becomes 0. For example, in the image forming device 200, when an image is not formed on body paper of a book and in a case where only timing of ejecting the body paper of a book from the ejecting point b is controlled, a value of T6 becomes 0. The conveyance time before converging T6 is previously stored in the storage unit 520.

As described above, the insertion device 500 determines insertion timing of the insertion paper I or timing of feeding the following body paper of a book Bf to the image forming device 200 by using time Tn of each kind of processing during insertion.

An example of a state of inserting the insertion paper I will be described with reference to FIGS. 4 to 5B.

Figure 5A:
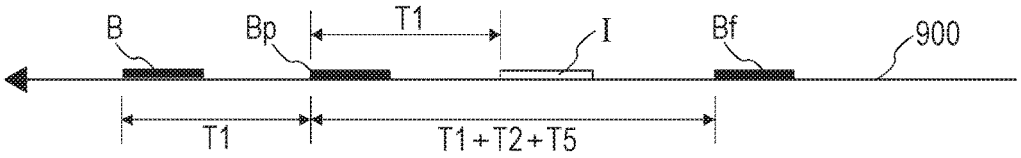
FIGS. 5A and 5B are views illustrating a method of calculating feed timing of following body paper of a book.
Figure 5B:
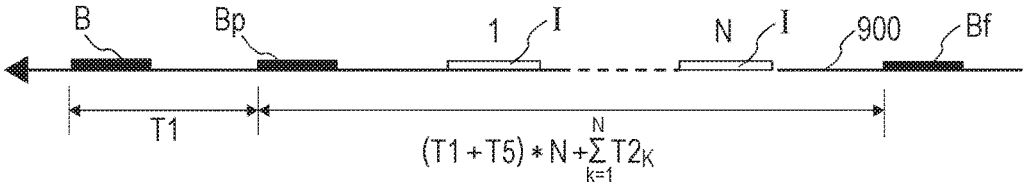

FIGS. 5A and 5B are views illustrating a method of calculating feed timing of following body paper of a book.

When receiving an insertion request of the insertion paper I, the insertion device 500 separates the insertion paper I with the separating unit 550. Here, the insertion device 500 measures the separation time T2. The insertion device 500 makes the separated insertion paper I wait at the pre-paper-feeding point d and converges the insertion paper I from the converging point c at timing at which the insertion paper I is conveyed after the preceding body paper of a book Bp at the conveyance interval T1. Since the separated insertion paper I is made to wait at the pre-paper-feeding point d, it is possible to control an interval between the preceding body paper of a book Bp and the insertion paper I as the conveyance interval T1 regardless of the separation time T2.

The insertion device 500 calculates ideal feed timing (first feed timing) of the following body paper of a book Bf in such a manner that the following body paper of a book Bf is conveyed after the insertion paper I at the conveyance interval T1. As illustrated in FIG. 5A, the insertion device 500 combines the conveyance interval T1, the separation time T2, and the main paper-feeding time T5 and sets the first feed timing. That is, in the present embodiment, the first feed timing is calculated as a conveyance interval (time) between the preceding body paper of a book Bp and the following body paper of a book Bf. Note that in each of FIGS. 4 and 5A, a state in which one sheet of the insertion paper I is inserted into the body paper of a book B is illustrated. However, as illustrated in FIG. 5B, there is a case where a plurality of sheets of the insertion paper I is inserted. In this case, the insertion device 500 calculates, as first feed timing, time in which a fixed total value of the conveyance interval T1 and the main paper-feeding time 15 is multiplied by the number of sheets of the insertion paper I and is combined with each period of separation time 12 which is a variable value.

Operation of Image Forming System

In the following, an operation of the image forming system 1 will be described in detail as an operation of the image forming device 200 and an operation of the insertion device 500.

Operation of Image Forming Device 200

Figure 6:
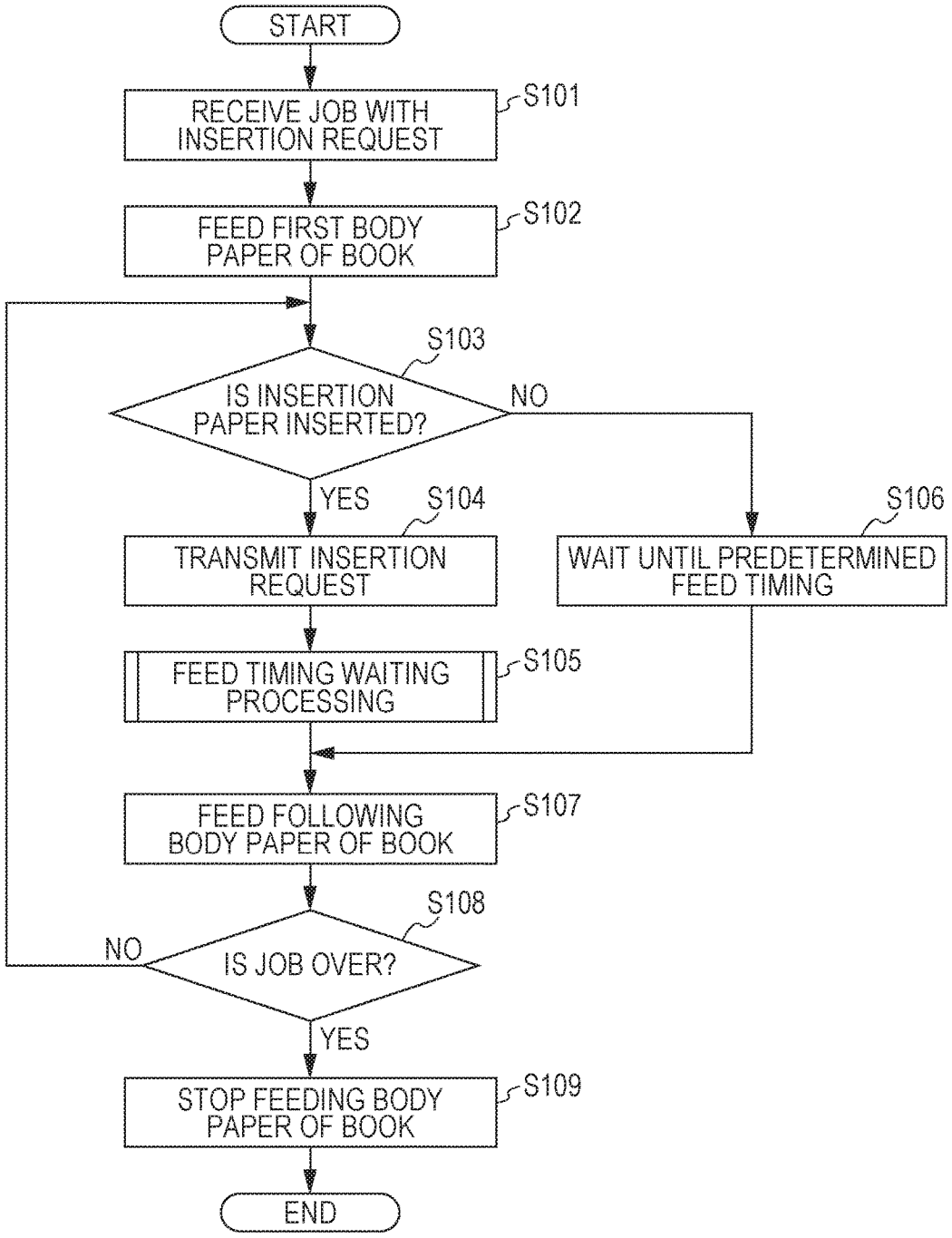
FIG. 6 is a flowchart illustrating a flow of an operation of an image forming device according to a first embodiment.

FIG. 6 is a flowchart illustrating a flow of an operation of the image forming device 200 according to the first embodiment. Algorithm illustrated in FIG. 6 is stored as a program in the storage unit 220 of the image forming device 200 and is executed by the control unit 210.

First, the control unit 210 receives a print, job (step S101). For example, from a host device in which a printer driver (not illustrated) is embedded, the control unit 210 receives a print job including an insertion request and acquires a kind and the number of sheets of body paper of a book, on which paper an image is to be formed, and an insertion request of the insertion paper I. For example, in the insertion request of the insertion paper I, an insertion point of the insertion paper I and a kind or the number of sheets of the insertion paper I inserted according to the insertion point are included. The insertion point is specified, for example, to follow Nth sheet of the body paper of a book B.

Then, the control unit 210 feeds first sheet of body paper of a book B (step S102). More specifically, the control unit 210 feeds, to the feed point a, the first one sheet of body paper of a book B which sheet is fed from the large-capacity paper feed tray 100 or the paper feed tray S1 or S2.

Then, with the print job, the control unit 210 checks whether insertion paper I is to be inserted after the currently-fed body paper of a book B (step S103).

When the insertion paper I is to be inserted (step S103: YES), the control unit 210 transmits an insertion request to the insertion device 500 (step S104) and performs feed timing waiting processing (step S105). A detail of the feed timing waiting processing will be described later.

On the other hand, when the insertion paper I is not to be inserted at this time (step S103: NO) the control unit 210 waits until feed timing of following body paper of a book B (step S106). For example, the control unit 210 waits for a period of the conveyance interval T1.

Then, the control unit 210 feeds the following body paper of a book B (step S107). Based on a determination whether processing of sheets of paper the number of which is requested by the print job is over, the control unit 210 determines whether to end the print job (step S108).

When it is determined that processing of all sheets of paper is not over yet and the print job is not to be ended (step S108: NO), the control unit 210 goes back to the processing in step S103.

On the other hand, when it is determined to end the print job (step S108: YES), the control unit 210 stops feeding the body paper of a book (step S109).

Feed Timing Waiting Processing

Figure 7:
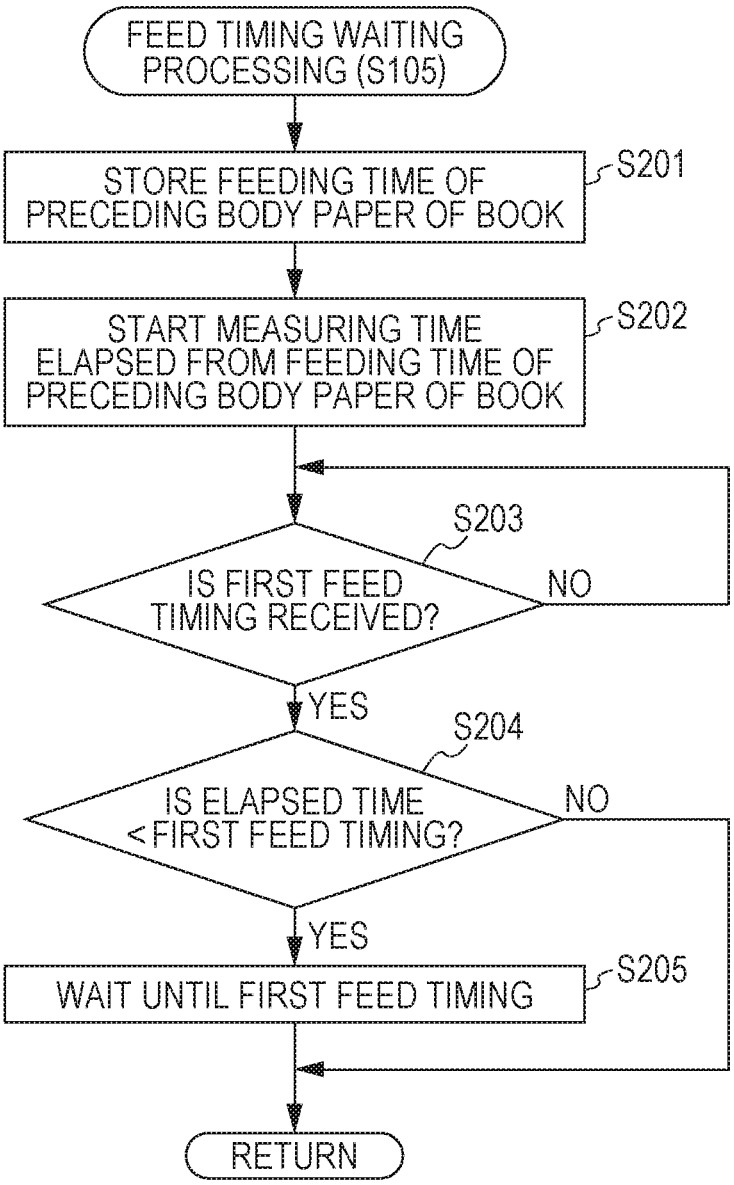
FIG. 7 is a flowchart illustrating a procedure of feed timing waiting processing of the first embodiment.

Then, the feed timing waiting processing (step S105) will be described in detail. FIG. 7 is a flowchart illustrating a procedure of the feed timing waiting processing. In the flowchart illustrated in FIG. 7, the image forming device 200 waits until timing at which the following body paper of a book Bf is fed after the insertion of the insertion paper I performed by the insertion device 500.

First, the control unit 210 stores time of feeding the preceding body paper of a book Bp which paper is fed most recently (step S201). More specifically, the control unit 210 stores, in the storage unit 220, time at which a leading end of the preceding body paper of a book Bp passes through the feed point a. The control unit 210 starts measuring elapsed time from the time of feeding the preceding body paper of a book Bp (step S202).

Then, the control unit 210 determines whether the first feed timing is received from the insertion device 500 (step S203). When the first feed timing is not received (step S203: NO), the control unit 210 waits until the first feed timing is received.

On the other hand, when the first feed timing is received (step S203: YES), the control unit 210 determines whether the elapsed time measurement of which is started in the processing in step S202 is shorter than the first feed timing (step S204). As described above, the first feed timing is notified as a conveyance interval between the preceding body paper of a book Bp and the following body paper of a book Bf, the control unit 210 compares a period of the conveyance interval with the elapsed time.

When the elapsed time is shorter than the first feed timing (step S204: YES), the control unit 210 waits until a measurement value of the elapsed time reaches the value of the first feed timing (step S205) and transitions to processing in step S107 in FIG. 6. On the other hand, when the measurement value of the elapsed time is greater than the value of the first feed timing (step S204: NO), the control unit 210 immediately transitions to the processing in step S107 in FIG. 6.

Operation of Insertion Device 500

Figure 8:
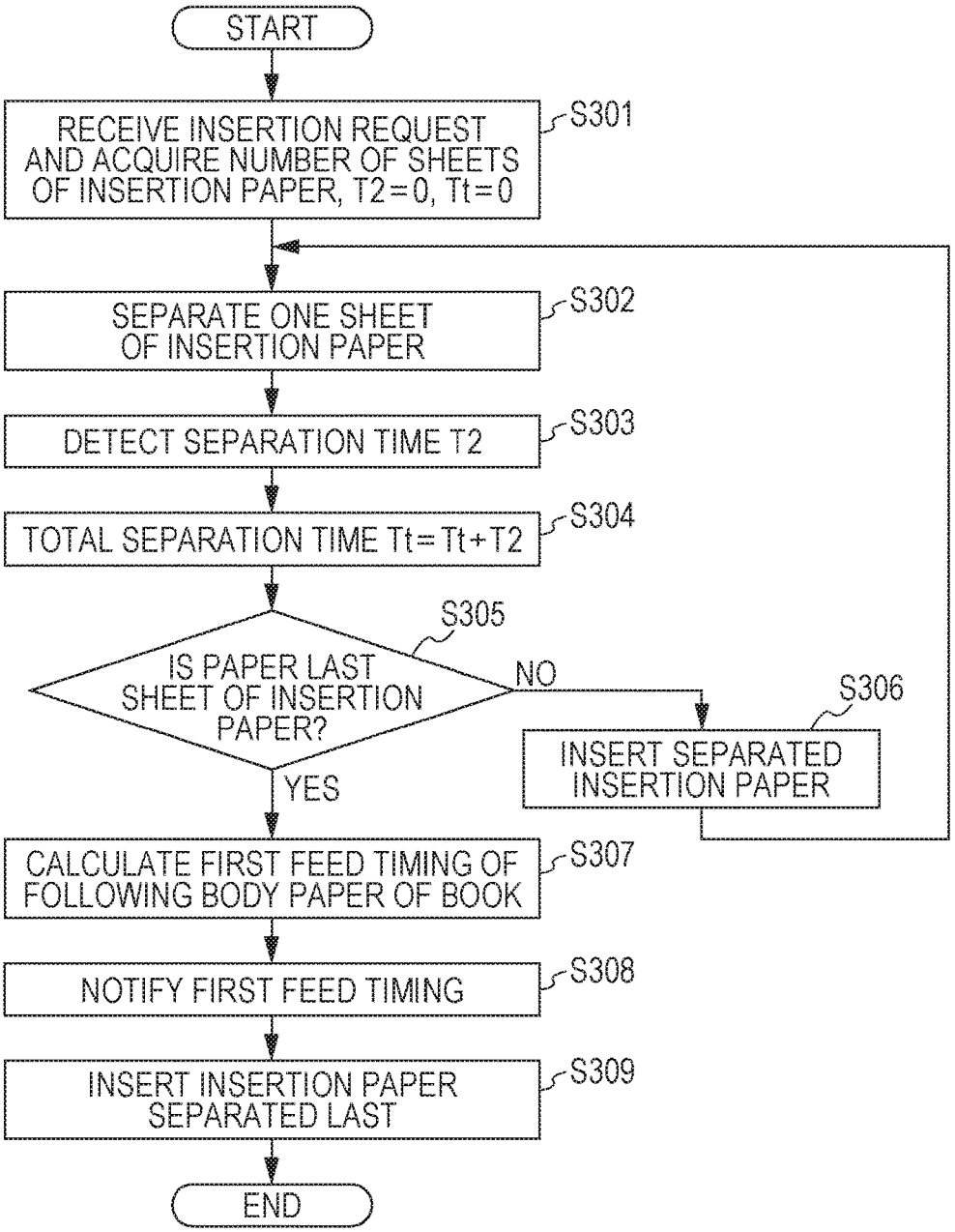
FIG. 8 is a flowchart illustrating a flow of an operation of an insertion device according to the first embodiment.

FIG. 8 is a flowchart illustrating a flow of an operation of the insertion device 500 according to the first embodiment. Algorithm illustrated in FIG. 8 is stored as a program in the storage unit 520 of the insertion device 500 and is executed by the control unit 510.

First, the control unit. 510 receives an insertion request from the image forming device 200, acquires the number of sheets of insertion paper I from the received insertion request, and assign an initial value 0 to the separation time T2 and total separation time Tt (step S301). Then, the control unit 510 separates one sheet of insertion paper I (step S302). The control unit 510 detects separation time T2 of the insertion paper I at this time (step S303).

The control unit 510 calculates the total separation time Tt (step S304). More specifically, the control unit 510 performs integration of the separation time T2 of the insertion paper I which time is detected in the processing in step S303.

Then, the control unit 510 determines whether paper is the last sheet of the insertion paper I (step S305). For example, the control unit 510 determines that the paper is the last sheet of the insertion paper I when the number of sheets of separated insertion paper I is identical to the number of sheets of insertion paper which number is included in the insertion request.

When the paper is not the last insertion paper I (step S305: NO), the control unit 510 inserts the separated insertion paper I into the conveyance path 900 (step S306) and goes back to the processing in step S302. For example, with the preceding body paper of a book Bp passing through the converging point c as a trigger, the control unit 510 controls the inserting unit 560 in such a manner that a paper distance with the preceding body paper of a book Bp satisfies the conveyance interval T1. However, this is not the limitation. It is possible to perform insertion by calculating insertion timing of the insertion paper I from the conveyance time before converging 16 of the preceding body paper of a book Bp which time is included in the insertion request.

On the other hand, when the paper is the last insertion paper I (step S305: YES), the control unit 510 calculates the first feed timing of the following body paper of a book Bf (step S307). More specifically, as illustrated in FIG. 5B, the control unit 510 calculates the first feed timing of the following body paper of a book as $(T1+T5)*N+\Sigma(T2_1+\ldots T2_N)$ according to the number of sheets N of the insertion paper I.

Then, the control unit 510 notifies the first feed timing, which is calculated in the processing in step S307, to the image forming device 200 through the communication unit 530 (step S308) and inserts the last-separated insertion paper I into the conveyance path 900 (step S309).

As described above, according to the image forming system 1 of the first embodiment, in the insertion device 500, the first feed timing is transmitted to the image forming device 200 when the separation is over. That is, the first feed timing can be transmitted before the insertion of the insertion paper I is completed. Thus, compared to a case of transmitting a notice indicating that the insertion of the insertion paper I is completed to the image forming device 200, it is possible to accelerate feeding of the following body paper of a book Bf in the image forming device 200. Thus, it is possible to improve productivity of the entire image forming system 1.

When the image forming device 200 feeds the following body paper of a book Bf to the conveyance path 900 at the first feed timing, an interval between the insertion paper I and the following body paper of a book Bf becomes the ideal conveyance interval T1. Thus, the conveyance interval does not become long and productivity can be improved.

Note that when there are many sheets of insertion paper I, the first feed timing cannot be notified until separation of all sheets of insertion paper I is completed. In order to complete separation of all sheets of paper, the paper other than the last sheet needs to be inserted into the conveyance path 900. Thus, when there are many sheets of insertion paper, it takes a long time to notify the first feed timing and there is a case where the first feed timing is already passed at a time point at which the first feed timing is notified (step S204: NO). Even in such a case, since the image forming device 200 immediately feeds the following body paper of a book Bf, it is possible to make a delay in productivity as little as possible.

Note that in the image forming system 1, passing of the preceding body paper of a book Bp is detected with the feed point a as a reference point and feeding of the following body paper of a book Bf is controlled based on the first feed timing. However, the first embodiment is not limited to this. Ejection of the preceding body paper of a book Bp may be detected with the ejecting point b as a reference point and ejection of the following body paper of a book Bf may be controlled based on the first feed timing.

First Example

Next, a first example to which the first embodiment is actually applied will be described.

FIGS. 9A to 9C are charts illustrating examples of insertion of insertion paper I performed by the image forming system 1 according to the first embodiment. Values of various periods T1 and T3 to T6 illustrated in FIG. 9A are previously stored in the storage unit 520 or determined according to an insertion request received from the image forming device 200. FIG. 9B is a chart illustrating, as the first example, time, place, and contents of each event generated in the image forming system 1. FIG. 9C is a chart illustrating, as a first comparison example, time, place, and contents of each event generated in a case where following body paper of a book is fed in consideration of the maximum separation time of the insertion paper I.

Note that in each of the first example illustrated in FIG. 9B and the first comparison example illustrated in FIG. 9C, two sheets of the insertion paper I are inserted.

In a chart of generation of an event in the first example illustrated in FIG. 9B, the image forming device 200 feeds the preceding body paper of a book Bp to the conveyance path 900 and a time point at which the insertion request is transmitted is set as a starting point (time=0 ms). Then, the insertion device 500 starts separating first sheet of insertion paper I without any time lag (or with time lag which can be ignored). Separation of the first sheet is completed at a measurement value $T2_1$=1000 ms. Then, the insertion device 500 inserts the insertion paper I at the time of 2500 ms in such a manner that an interval between the preceding body paper of a book Bp which passes through the converging point c and the first sheet of insertion paper I becomes a conveyance interval T1=500. After the insertion of the first sheet is completed, separation of a second sheet of insertion paper I is started (time=3000 ms) and the separation is completed at a measurement value $T2_2$=900 ms (time=3900 ms).

At this time point, the insertion device 500 calculates first feed timing and notifies the timing to the image forming device 200. In calculation of the first feed timing, 3900 ms is calculated from (T1 (=500)+T5 (=500))×2+$T2_1$ (=1000)+$T2_2$ (=900). Since the notified first feed timing is 3900 ms, the image forming device 200 starts feeding the following body paper of a book Bf at the time of 3900 ms. Since conveyance time before converging T6 is 2000 ms, the following body paper of a book Bf reaches the converging point c at the time of 5900 ms.

On the other hand, in a chart of generation of an event in the first comparison example illustrated in FIG. 9C, the insertion device calculates, as second feed timing, T1 (=500)×2+(T4 (=3000)+T5 (=500))×2=8000 ms (time=0 ms). In this calculation expression, the maximum time which may be necessary for separation to securely absorb a variation in separation time of two sheets of insertion paper is considered. Thus, in the first comparison example illustrated in FIG. 9C, timing at which the image forming device feeds following body paper of a book becomes the time of 8000 ms and the following body paper of a book reaches the converging point c at the time of 10000 ms.

When timing of feeding following body paper of a book in the first example and that in the first comparison example are compared to each other, it is understood that the timing in the first example is earlier for 4100 ms. Thus, improvement in productivity can be checked in the first example to which the present embodiment is applied.

Second Embodiment

In the image forming system 1 according to the above-described first embodiment, the insertion device 500 only transmits, to the image forming device 200, the first feed timing calculated based on separation time of the insertion paper I. In the second embodiment, an insertion device 500 also transmits, to an image forming device 200, second feed timing calculated based on the maximum time which may be necessary for separation of insertion paper I.

A basic configuration of an image forming system according to the second embodiment is similar to that of the first embodiment. However, an operation of the image forming device 200 and an operation of the insertion device 500 are partially different from those in the first embodiment. Thus, in the following, the operation of the image forming device 200 and that of the insertion device 500 will be described.

First, the operation of the insertion device 500 of the second embodiment will be described.

Operation of Insertion Device 500

Figure 10:
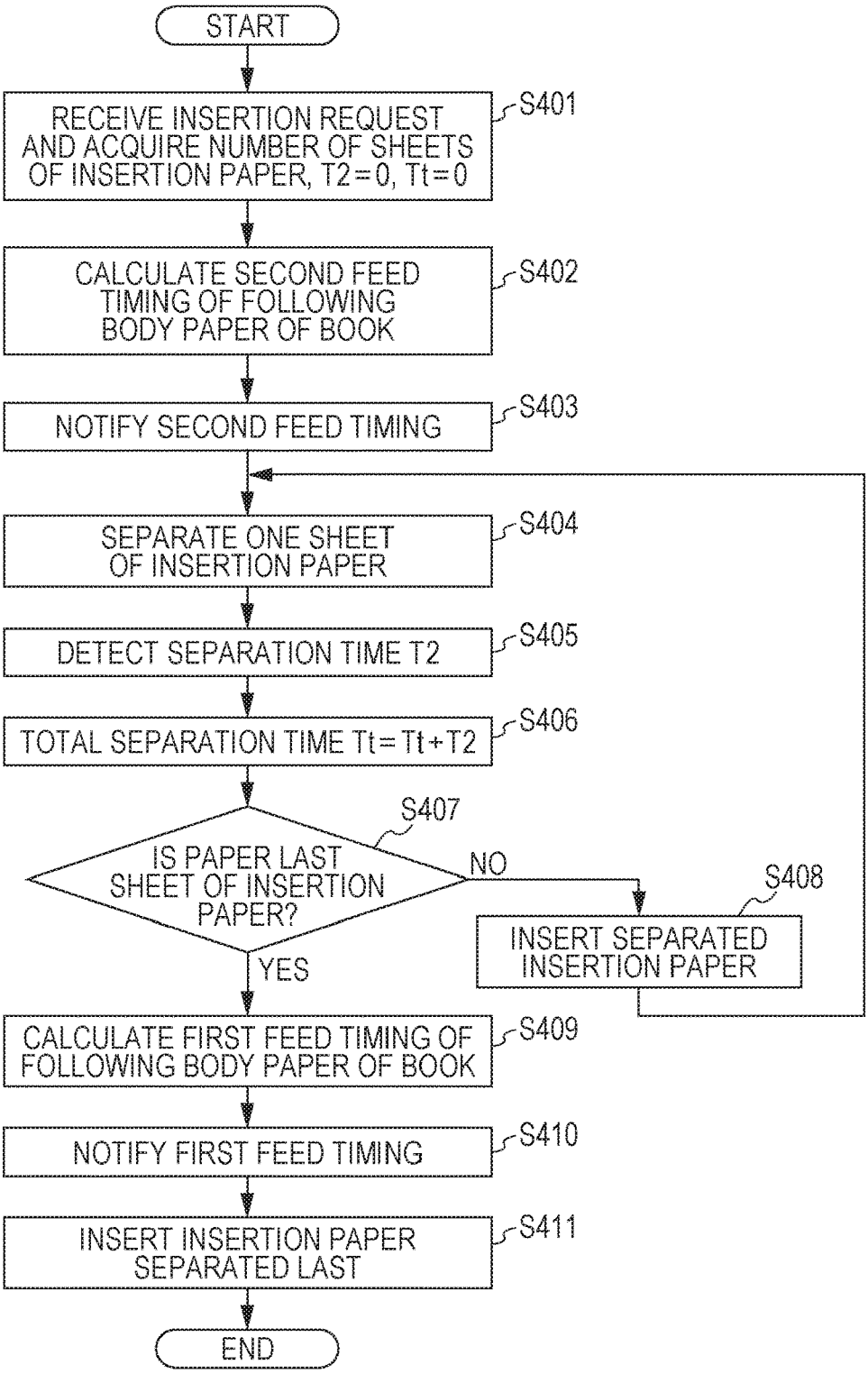
FIG. 10 is a flowchart illustrating a flow of an operation of an insertion device according to a second embodiment.

FIG. 10 is a flowchart illustrating a flow of an operation of the insertion device according to the second embodiment.

As illustrated in FIG. 10, the operation of the insertion device 500 according to the second embodiment is different from that of the insertion device 500 according to the first embodiment in a point that processing in step S402 and step S403 is added. More specifically, processing contents of processing in step S401 and step S404 to step S411 of the second embodiment are identical to those of the processing in step S301 to step S309 of the first embodiment. Thus, in the second embodiment, a description of the processing similar to that of the first embodiment will be omitted.

After the processing in step S401, a control unit 510 calculates second feed timing of following body paper of a book Bf (step S402). The second feed timing is calculated based on the maximum time T4 which may be necessary for separating the insertion paper I and main paper-feeding time T5. More specifically, the total of the maximum time T4 and the main paper-feeding time T5 is the maximum value of time necessary for inserting one sheet of insertion paper I. Thus, the second feed timing is calculated by multiplying the total by the number of sheets n of insertion paper I. That is, the second feed timing is timing of theoretically-calculated maximum value which may be necessary for insertion of the insertion paper I. The second feed timing is calculated as a conveyance interval between preceding body paper of a book Bp and following body paper of a book Bf.

Then, the control unit 510 notifies, to the image forming device 200, the second feed timing calculated in the processing in step S402 (step S403). The second feed timing is a theoretical value and can be calculated without measurement of actual separation time T2. Thus, the second feed timing can be notified to the image forming device 200 before notification of first feed timing.

Operation of Image Forming Device 200

In the second embodiment, the operation of the image forming device 200 is similar to the operation of the image forming device 200 according to the first embodiment illustrated in FIG. 6 other than a point that feed timing waiting processing (S105) is different. Thus, in the following, only a procedure of feed timing waiting processing of the image forming device 200 in the second embodiment which procedure is different from that of the first embodiment will be described.

Figure 11:
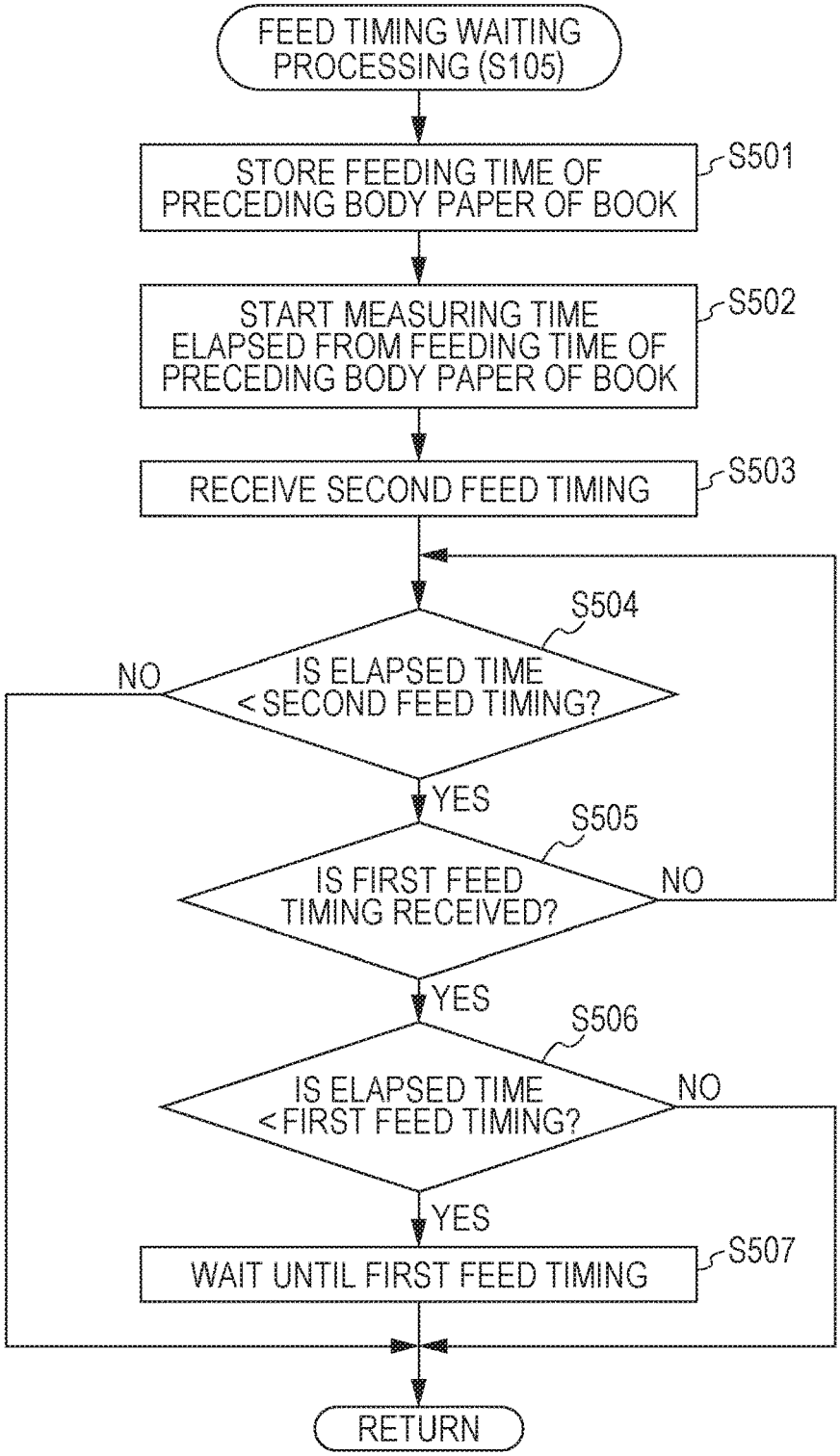
FIG. 11 is a flowchart illustrating a procedure of feed timing waiting processing or the second embodiment.

FIG. 11 is a flowchart illustrating a detail processing procedure of the feed timing waiting processing (S105) of the second embodiment which processing is illustrated in FIG. 6.

As illustrated in FIG. 11, processing in step S501, S502, S506, and S507 of the feed timing waiting processing of the second embodiment is identical to the processing in step S201, S202, S204, and S205 of the first embodiment which processing is illustrated in FIG. 7. Thus, in the second embodiment, a description of the processing similar to that of the first embodiment will be omitted. In the following, only processing in step S503 to S505 which is different from the feed timing waiting processing of the first embodiment which processing is illustrated in FIG. 7 will be described.

After the processing in step S502, the control unit 210 receives second feed timing from the insertion device 500 (step S503). A control unit 210 determines whether elapsed time after feeding of the preceding body paper of a book Bp is shorter than the second feed timing (step S504). Here, since the second feed timing is notified as a conveyance interval between the preceding body paper of a book Bp and the following body paper of a book Bf, the control unit 210 compares a period, of the conveyance interval with the elapsed time.

When the elapsed time is shorter than the second feed timing (step S504: YES), the control unit 210 transitions to the processing in step S505. The control unit 210 determines whether the first feed timing is received (step S505). When the first feed timing is not received (step S505: NO), the control unit 210 goes back to the processing in step S504. When the first feed timing is received (step S505: YES), the control unit 210 transitions to the processing in step S506.

On the other hand, when the elapsed time is equal to or longer than the second feed timing (step S504: NO), the control unit 210 immediately transitions to the processing in step S107 in FIG. 6.

In such a manner, the time elapsed from feeding of the preceding body paper of a book Bp reaches the second feed timing before the first feed timing is received, the control unit 210 feeds the following body paper of a book to the conveyance path 900. Thus, the image forming device 200 can feed the following body paper of a book Bf to the conveyance path 900 at the second feed timing at the latest. Since being calculated based on the actual separation time, usually the first feed timing is earlier than the second feed timing. However, when the number of sheets of insertion paper I becomes greater, it takes more time to notify the first feed timing since actual separation time of each sheet of insertion paper I is measured. There may be a case where the first feed timing and the second feed timing are already passed when the first feed timing is notified from the insertion device 500. Even in such a case, at least feeding of the following body paper of a book Bf according to the second feed timing is secured. Thus, decrease in productivity can be prevented.

Second and Third Example

FIGS. 12A to 12C are charts illustrating examples of insertion of insertion paper I performed by an image forming system 1 according to the second embodiment. Values of various periods T1 and T3 to T6 illustrated in FIG. 12A are previously stored in the storage unit 520 or determined according to an insertion request received from the image forming device 200. FIG. 12B is a chart illustrating, as the second example, time, place, and contents of each event generated in the image forming system 1 according to the second embodiment. FIG. 12C is a chart illustrating, as the third example, time, place, and contents of each event generated in a case where following body paper of a book is fed based only on first feed timing.

Note that in each of the second example illustrated in FIG. 12B and the third example illustrated in FIG. 12C, two sheets of insertion paper I are inserted.

In a chart of generation of an event in the second example illustrated in FIG. 12B, the image forming device 200 feeds the preceding body paper of a book Bp to the conveyance path 900 and a time point at which an insertion request is transmitted is set as a starting point (time=0 ms). At the time of 0 ms, second feed timing is notified to the image forming device 200. The second feed timing is calculated as T1 (=500)×2+(T4 (=3000)+T5 (=500))×2=8000 ms. In this calculation expression, the maximum time which may be necessary for separation to securely absorb a variation in separation time of two sheets of insertion paper is considered. As illustrated in FIG. 12A, conveyance rime before converging T6 elapsed until the body paper of a book B reaches the converging point c is long and is 6000 ms. Thus, it takes more time to complete insertion of first sheet of insertion paper I, the insertion being completed at the time of 7000 ms. Further, separation of second sheet of insertion paper I is completed at the time of 6500 ms. At this time point, the time already passes the calculated second feed timing 8000 ms. However, in the second example, feeding of the following body paper of a book Bf is started at a time point of 8000 ms without waiting for notification of the first feed timing.

On the other hand, similarly to the first example, the image forming device 200 does not receive second feed timing in the third example illustrated in FIG. 12C. That is, the image forming device 200 waits for first feed timing. In the third example, the first feed timing is calculated as 5000 ms from (T1 (=500)+T5 (=500))×2+$T2_1$ (=1500)+$T2_2$ (=1500). However, notification is made at a time point at which separation of second sheet of insertion paper I is completed, that is, at the time of 8500 ms. Thus, the image forming device 200 immediately starts feeding the following body paper of a book Bf when receiving the first feed timing. The following body paper of a book Bf is fed at the time of 8500 ms.

When timing of feeding the following body paper of a book of the second example and that of the third example are compared to each other, it is understood that the timing of the second example is earlier for 500 ms. Thus, it can be checked that a decrease in productivity due to dependence only on first feed timing can be prevented by receiving not only notification of the first feed timing but also that of second feed timing and by employing the second feed timing in some cases. Although not described as an example, there is a case where timing becomes earlier by employing the first feed timing even when the second feed timing is received. In the second embodiment, earlier one of the first feed timing and the second feed timing can be employed.

Third Embodiment

In the image forming system according to each of the first and second embodiments, each of the first feed timing and the second feed timing is notified as a conveyance interval between the preceding body paper of a book Bp and the following body paper of a book Bf. That is, with a time point at which the preceding body paper of a book Bp is fed to the conveyance path 900 as a starting point, time elapsed from the time point at which the preceding body paper of a book Bp is fed until a time point at which the following body paper of a book Bf is fed to the conveyance path 900 is notified as the feed timing. However, in the third embodiment, a time point at which preceding body paper of a book Bp is fed is not considered. With a time point of notification of feed timing as a starting point, time elapsed from the time point of notification until a time point at which following body paper of a book Bf is fed is notified as feed timing.

A basic configuration of an image forming system according to the third embodiment is similar to that of the first embodiment.

Thus, in the following, only an operation of an image forming device 200 and an operation of an insertion device 500 in the third embodiment which operations are different from those in the first embodiment will be described.

Operation of Image Forming Device

Figure 13:
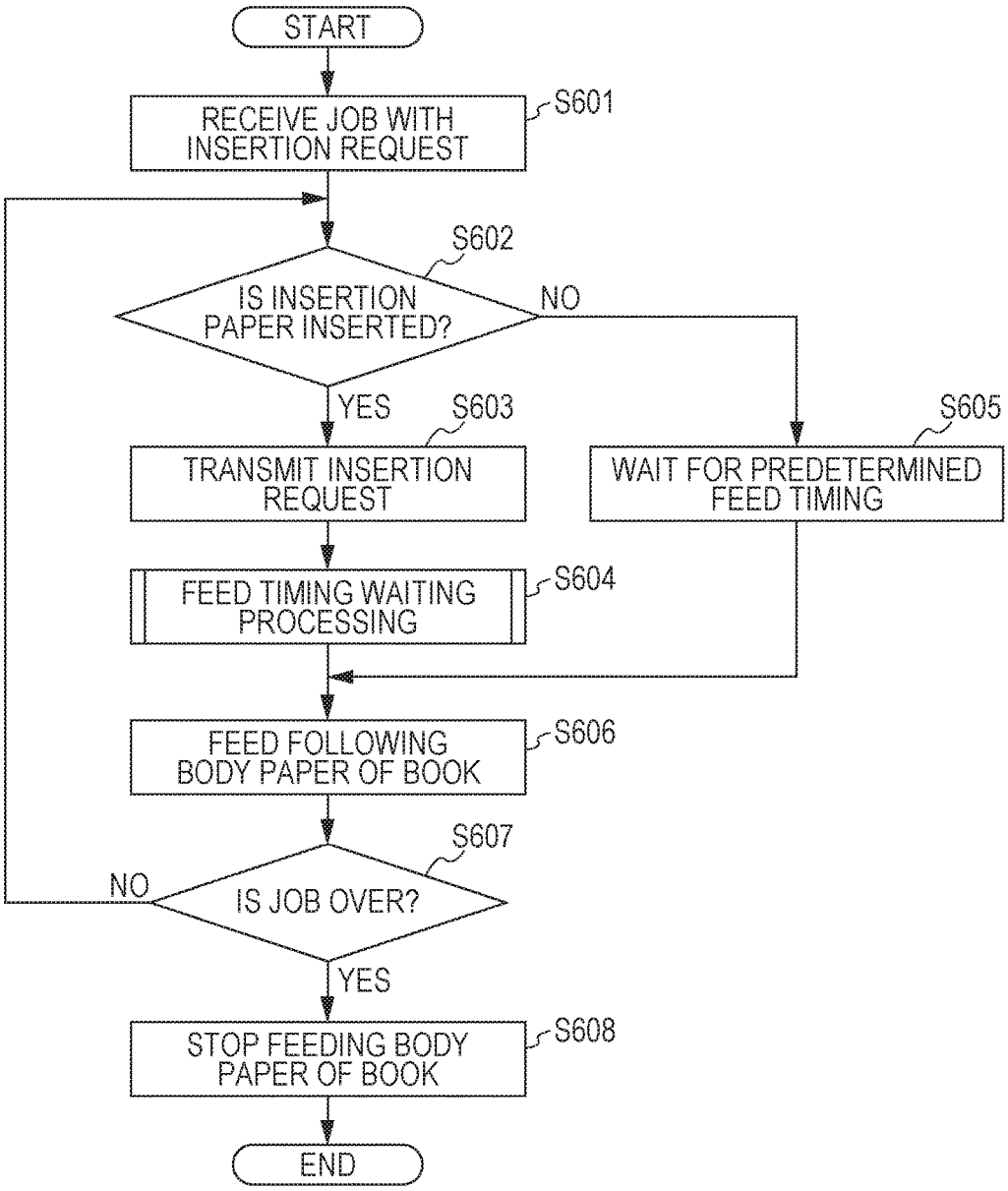
FIG. 13 is a flowchart illustrating a flow of an operation of an image forming device according to a third embodiment.

FIG. 13 is a flowchart illustrating a flow of an operation of the image forming device according to the third embodiment.

As illustrated in FIG. 13, the operation of the image forming device 200 according to the third embodiment is different from the operation of the image forming device 200 of the first embodiment illustrated in FIG. 6 in a point that processing in step S102 is omitted and different processing contents are included in feed timing waiting processing (S604). More specifically, processing contents of processing in step S601 to S608 in the third embodiment and those of the processing in step S101 and S103 to S109 of the first embodiment are identical to each other. Thus, in the third embodiment, a description of the processing similar to that of the first embodiment will be omitted.

Since the processing in step S102 in FIG. 6 is omitted, a first page of a final printed material is not necessarily body paper of a book B in the third embodiment. An operation in step S604 will be described with reference to FIG. 14.

Feed Timing Waiting Processing

Figure 14:
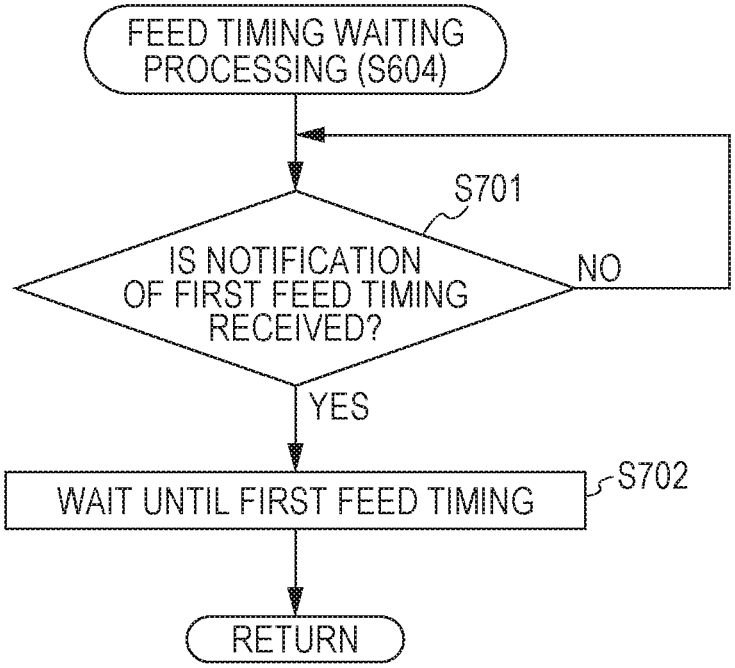
FIG. 14 is a flowchart, illustrating a procedure of feed timing waiting processing of the third embodiment.

FIG. 14 is a flowchart illustrating a detail processing procedure of the feed timing waiting processing (S604) in the third embodiment.

First, a control unit 210 determines whether first feed timing is received (step S701). When the first feed timing is not received (step S701: NO), the control unit 210 waits until the first feed timing is received.

On the other hand, when notification cation of the first feed timing is received (step S701: YES), the control unit 210 waits until the first feed timing (step S702) and transitions to processing in step S606 illustrated in FIG. 13.

In such a manner, in the third embodiment, it is not necessary for the control unit 210 to store time of feeding the preceding body paper of a book Bp or to measure elapsed time from the time of feeding the preceding body paper of a book Bp unlike the case of the first embodiment. Thus, control is easy compared to the first embodiment.

Operation of Insertion Device

Figure 15:
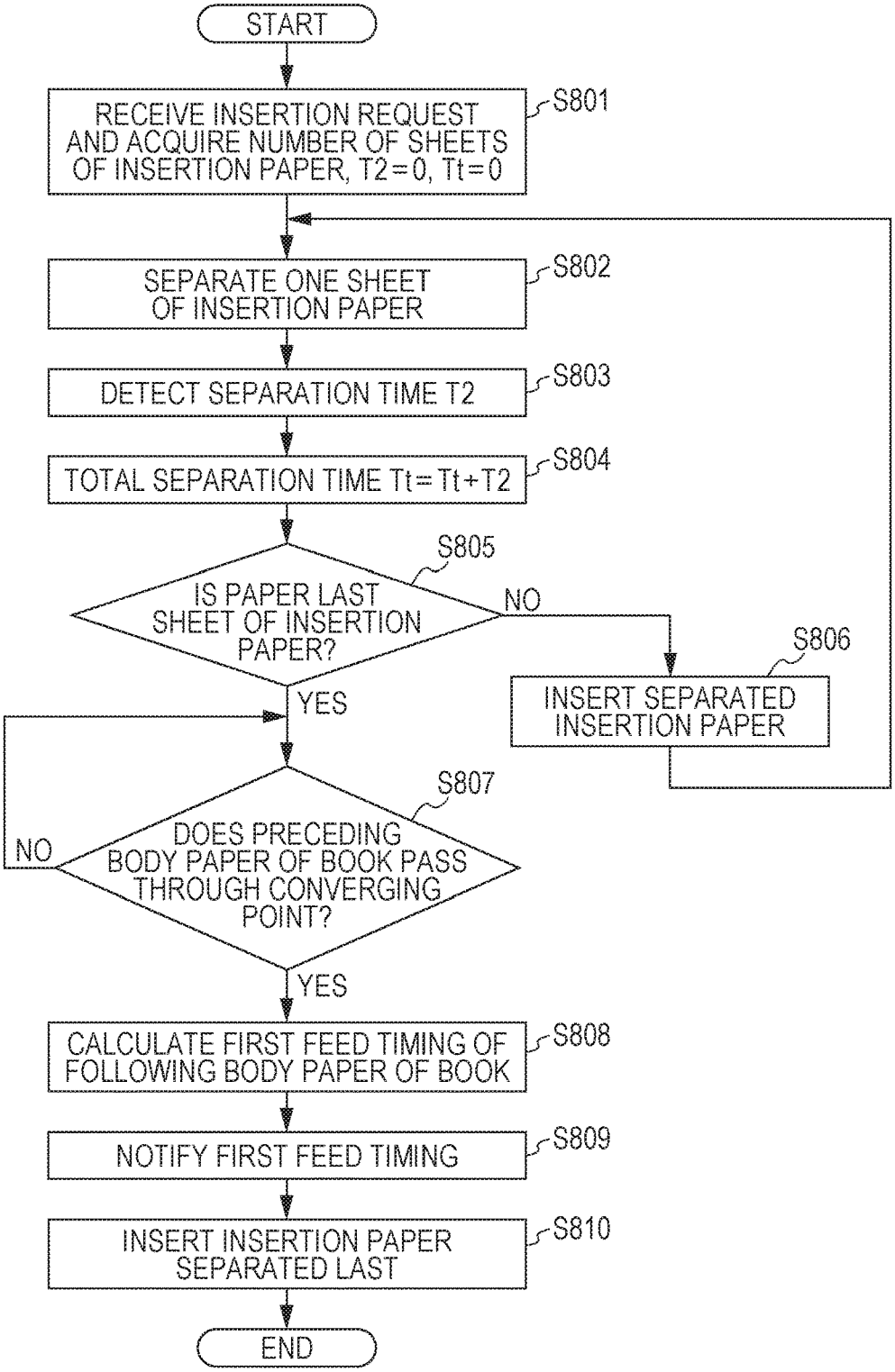
FIG. 15 is a flowchart illustrating a flow of an operation of an insertion device according to the third embodiment.

FIG. 15 is a flowchart illustrating a flow of an operation of an insertion device according to the third embodiment.

As illustrated in FIG. 15, the operation of the insertion device 500 according to the third embodiment is different from that of the insertion device 500 according to the first embodiment in a point that processing in step S807 is added. More specifically, processing in step S801 to S806 and S808 to S810 of the third embodiment is identical to the processing in step S301 to S309 in the first embodiment. Thus, in the third embodiment, a description of the processing similar to that of the first embodiment will be omitted.

In the processing in step S805, when it is determined that paper is the last insertion paper I (step S805: YES), a control unit 510 determines whether preceding body paper of a book passes through a converging point c (step S807). When the preceding body paper of a book does not pass through the converging point c (step S807: NO), the control unit 510 waits until the preceding body paper of a book passes through the converging point c.

On the other hand, when the preceding body paper of a book passes through the converging point c (step S807: YES) the control unit 510 makes the processing transition to step S808.

In such a manner, in the third embodiment, the insertion device 500 cannot notify the first feed timing until the preceding body paper of a book Bp passes through the converging point c. This is because the first feed timing is notified as an interval from a time point of notification in the third embodiment Timing of the preceding body paper of a book Bp is not related to the first feed timing itself. Thus, in the third embodiment, it is necessary to adjust the timing of notification by the processing in step S807.

Note that in the above description, it is described that the first feed timing is notified as elapsed time from the time point, of notification. However, second feed timing can be also notified as elapsed time from the time point of notification.

First Modification Example

In the above-described third embodiment, as the feed timing waiting processing (S604), the image forming device 200 simply waits until the first feed timing after notification is received. However, it is possible to reduce waiting time based on a relationship between time until first feed timing and conveyance time before converging 16.

Figure 16:
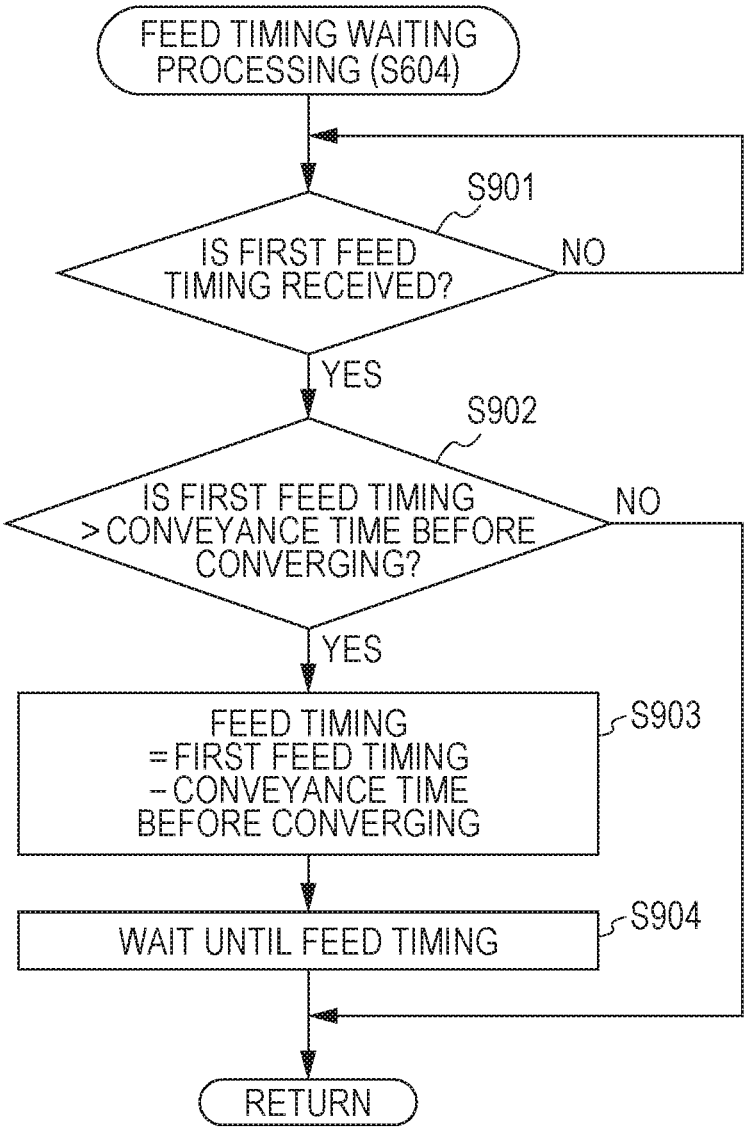
FIG. 16 is a flowchart illustrating a procedure of feed timing waiting processing of a first modification example.

FIG. 16 is a flowchart illustrating a procedure of feed timing waiting processing of the first modification example.

As illustrated in FIG. 16, the feed timing waiting processing of the first modification example is different from the feed timing waiting processing of the third embodiment in a point that processing in step S902 and S903 is added. That is, processing in step S901 to S904 in the first modification example is identical to the processing in step S701 and S702 in the third embodiment. Thus, in the first modification example, a description of the processing similar to that of the third embodiment will be omitted.

In the processing in step S901, when first feed timing is received (step S901: YES), a control unit 210 determines whether the first feed timing (time until following body paper of book Bf is fed after notification is made) is longer than conveyance time before converging 16 (step S902).

When the first feed timing is equal to or shorter than the conveyance time before converging 16 (step S902: NO), the control unit 210 immediately transitions to the processing in the step S606 illustrated in FIG. 13.

On the other hand, when the first feed timing is longer than the conveyance time before converging 16 (step S902: YES), the control unit 210 calculates, as new feed timing, value in which the conveyance time before converging 16 is subtracted from the first feed timing (step S903). Then, the control unit 210 waits until the newly-calculated feed timing (step S904) and transitions to the processing in step S606 illustrated in FIG. 13.

Fourth and Fifth Example

FIGS. 17A to 17C are charts illustrating examples of insertion of insertion paper I performed by an image forming system 1 according to the first modification example. Values of various periods T1 and T3 to T6 illustrated in FIG. 17A are previously stored in a storage unit 520 or determined according to an insertion request received from an image forming device 200. FIG. 17B is a chart illustrating, as the fourth example, time, place, and contents of each event generated in the first modification example. FIG. 17C is a chart illustrating, as the fifth example, time, place, and contents of each event generated in the image forming system according to the third embodiment to which the first modification example is not applied. Note that in each of the fourth example illustrated in FIG. 17B and the fifth example illustrated in FIG. 17C, two sheets of the insertion paper I are inserted. In each of FIGS. 17B and 17C, a time point at which the image forming device 200 feeds preceding body paper of a book Bp to a conveyance path 900 and transmits an insertion request is set as a starting point (time=0 ms).

In a case of the fourth example in FIG. 17B, first feed timing is calculated as 3900 ms at the time of 3900 ms. That is, in 3900 ms after the first feed timing is notified, it becomes timing to feed the following body paper of a book Bf. However, here, the image forming device 200 compares 3900 ms, which is the first feed timing, with the conveyance time before converging T6=2000 ms. Since the first feed timing is loner, 2000 ms is subtracted from 3900 ms. Then, the image forming device 200 sets the subtraction result indicating timing of 1900 ms later, that is, time 5800 ms as feed timing of the following body paper of a book Bf.

On the other hand, in a case of the fifth example in FIG. 17C, first feed timing is calculated as 3900 ms at the time of 3900 ms. Then, the image forming device 200 feeds the following body paper of a book Bf at the time of 7800 ms at which 3900 ms is elapsed from the first feed timing.

When the timing of feeding the following body paper of a book of the fourth example and that of the fifth example are compared to each other, that of the fourth example is earlier for 2000 ms. Thus, it can be checked that it is possible to further improve productivity by accelerating feeding of the following body paper of a book Bf for a period of the conveyance time before converging T6 in a case where the calculated first feed timing is longer than the conveyance time before converging T6.

In each of the above-described embodiments, the image forming system feeds following body paper of a book to the conveyance path 900 by transmission/reception between the image forming device 200 and the insertion device 500. However, the present invention is not limited to this and a function of the control unit 510 may be realized by the control unit 210.

In each of the above-described embodiments, a case where an operation of each of the image forming device and the insertion device in the image forming system is executed by software has been described. However, entire processing may not be realized by software. A part of the processing may be realized by a special hardware circuit or a plurality of kinds of hardware.

Further, a program to operate the image forming device and the insertion device may be provided by a USB memory, a flexible disk, or a computer-readable recording medium such as a CD-ROM or may be provided online through a network such as the Internet. Further, this program may be provided as single application software or may be embedded into software as a function of the image forming device and the insertion device.

In the above, preferred embodiments of the present invention have been described. However, these are examples for a description of the present invention and the scope of the present invention is not limited to these embodiments. The present invention can be executed in various modes different from the above embodiments within the spirit and the scope thereof.

According to an insertion device, an image forming system, an image forming device, a method executed by the image forming device, and a control program to control the image forming device of an embodiment of the present invention, feed timing of a following first recording medium is calculated based on separation time of a second recording medium. Thus, it is possible to improve productivity of when a second recording medium is inserted between a plurality of first recording media.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An insertion device which inserts a second recording medium into a conveyance path along which a plurality of first recording media fed from a feeding device are conveyed, the insertion device comprising:

a loading unit in which the second recording medium is loaded;

a separating unit configured to separate the second recording medium, which is loaded in the loading unit, one by one according to an insertion request from the feeding device;

a sensor provided at a predetermined position between the separating unit and the conveyance path and configured to detect a leading end of the second recording medium;

a detection unit configured to detect a separation time of the second recording medium performed by the separating unit, the separation time being a time interval from a time point at which the separating unit starts separating the second recording medium to a time point at which a leading end of the second recording medium is detected by the sensor;

a processor configured to calculate a first feed timing at which a following first recording medium, which is to be conveyed in the conveyance path after the second recording medium, is to be fed to the conveyance path based on the separation time detected by the detection unit;

a notification unit configured to notify the first feed timing to the feeding device; and an inserting unit configured to convey the second recording medium separated by the separating unit to a converging point in the conveyance path and to insert the second recording medium into the conveyance path.

2. The insertion device according to claim 1, wherein:

when receiving the insertion request, the processor further calculates a second feed timing at which to feed the following first recording medium to the conveyance path based on a maximum time necessary to separate the second recording medium with the separating unit and a time elapsed until the second recording medium is inserted by the inserting unit, and the notification unit further notifies the second feed timing to the feeding device.

3. An image forming system comprising:

an image forming device configured to form an image on a plurality of first recording media;

a conveyance path configured to convey the first recording media fed from the image forming device; and an insertion device configured to insert a second recording medium into the conveyance path, wherein the insertion device includes a loading unit in which the second recording medium is loaded, a separating unit configured to separate the second recording medium, which is loaded in the loading unit, one by one according to an insertion request from the image forming device, a sensor provided at a predetermined position between the separating unit and the conveyance path and configured to detect a leading end of the second recording medium, a detection unit configured to detect a separation time of the second recording medium performed by the separating unit, the separation time being a time interval from a time point at which the separating unit starts separating the second recording medium to a time point at which a leading end of the second recording medium is detected by the sensor, a first processor configured to calculate a first feed timing at which a following first recording medium, which is to be conveyed in the conveyance path after the second recording medium, is to be fed to the conveyance path based on the separation time detected by the detection unit, a notification unit configured to notify the first feed timing to the image forming device, and an inserting unit configured to convey the second recording medium separated by the separating unit to a converging point in the conveyance path and to insert the second recording medium into the conveyance path, and wherein the image forming device includes an image forming unit configured to form the image on the plurality of first recording media, and a second processor configured to perform control to feed the following first recording medium to the conveyance path based on the first feed timing.

4. The image forming system according to claim 3, wherein:

the image forming device further includes a measuring unit configured to measure an elapsed time which has elapsed from a time point at which a preceding first recording medium conveyed in the conveyance path before the second recording medium to be inserted is fed to the conveyance path, and the second processor further performs control to feed the following first recording medium to the conveyance path at the first feed timing when the elapsed time has not reached the first feed timing at a time point at which the first feed timing is received from the notification unit, and to immediately feed the following first recording medium to the conveyance path when the elapsed time exceeds the first feed timing.

5. The image forming system according to claim 4, wherein:

when receiving the insertion request, the first processor further calculates a second feed timing at which to feed the following first recording medium to the conveyance path based on a maximum time necessary for the separating unit to separate the recording medium and a time elapsed until the recording medium is inserted by the inserting unit, the notification unit further notifies the second feed timing to the image forming device, and when the elapsed time reaches the second feed timing before the first feed timing is received from the notification unit, the second processor feeds the following first recording medium to the conveyance path.

6. The image forming system according to claim 3, wherein the second processor receives the first feed timing from the notification unit as a conveyance time interval between a time point at which a preceding first recording medium conveyed in the conveyance path before the second recording medium to be inserted is fed to the conveyance path and a time point at which the following first recording medium is fed to the conveyance path.

7. The image forming system according to claim 3, wherein the second processor receives the first feed timing from the notification unit as a conveyance time interval between a time point at which the first feed timing is received from the notification unit and a time point at which the following first recording medium is fed to the conveyance path.

8. The image forming system according to claim 7, wherein the notification unit notifies the first feed timing to the image forming device at a later one of (i) a time point at which the separating unit completes separating the second recording medium to be inserted and (ii) a time point at which the preceding first recording medium conveyed in the conveyance path before the second recording medium to be inserted is conveyed to the converging point.

9. An image forming device comprising:

an image forming unit configured to form an image on a plurality of first recording media based on a print job related to image-forming on the plurality of first recording media and including an insertion request requesting insertion of a second recording medium;

a conveyance path configured to convey the first recording media fed from the image forming unit;

a loading unit which is provided downstream in a conveyance direction of the image forming unit in the conveyance path and in which the second recording medium is loaded;

a separating unit configured to separate the second recording medium, which is loaded in the loading unit, one by one based on the print job;

a sensor provided at a predetermined position between the separating unit and the conveyance path and configured to detect a leading end of the second recording medium;

a detection unit configured to detect a separation time of the second recording medium performed by the separating unit, the separation time being a time interval from a time point at which the separating unit starts separating the second recording medium to a time point at which a leading end of the second recording medium is detected by the sensor;

a processor configured to (i) calculate a first feed timing at which a following first recording medium, which is to be conveyed in the conveyance path after the second recording medium, is to be fed to the conveyance path based on the separation time detected by the detection unit, and (ii) perform control to feed the following first recording medium to the conveyance path based on the calculated first feed timing; and an inserting unit configured to convey the second recording medium separated by the separating unit to a converging point in the conveyance path and to insert the second recording medium into the conveyance path.

10. A method executed by an image forming device, the method comprising:

a step (a) of forming an image on a plurality of first recording media with an image forming unit based on a print job related to image-forming on the plurality of first recording media and including an insertion request requesting insertion of a second recording medium;

a step (b) of separating, based on the print job, the second recording medium one by one from a loading unit, in which the second recording medium is loaded, with a separating unit which is provided downstream in a conveyance direction of the image forming unit in a conveyance path configured to convey the first recording media fed from the image forming unit;

a step (c) of detecting a separation time of the second recording medium with a detection unit, the separation time being a time interval from a time point at which the separating unit starts separating the second recording medium to a time point at which a leading end of the second recording medium is detected by a sensor provided at a predetermined position between the separating unit and the conveyance path;

a step (d) of calculating a first feed timing, which is a timing at which a following first recording medium to be conveyed in the conveyance path after the second recording medium is to be fed to the conveyance path, with a processor based on the detected separation time;

a step (e) of performing control to feed the following first recording medium to the conveyance path based on the calculated first feed timing; and a step (f) of conveying the second recording medium separated by the separating unit to a converging point in the conveyance path and inserting the second recording medium into the conveyance path with an inserting unit.

11. A non-transitory recording medium storing a computer readable control program thereon to control an image forming device, the program causing a computer to execute:

a procedure (A) to form an image on a plurality of first recording media with an image forming unit based on a print job related to image-forming on the plurality of first recording media and including an insertion request requesting insertion of a second recording medium;

a procedure (B) to separate, based on the print job, the second recording medium one by one from a loading unit, in which the second recording medium is loaded, with a separating unit which is provided downstream in a conveyance direction of the image forming unit in a conveyance path configured to convey the first recording media fed from the image forming unit;

a procedure (C) to detect a separation time of the second recording medium with a detection unit, the separation time being a time interval from a time point at which the separating unit starts separating the second recording medium to a time point at which a leading end of the second recording medium is detected by a sensor provided at a predetermined position between the separating unit and the conveyance path;

a procedure (D) to calculate a first feed timing, which is a timing at which a following first recording medium to be conveyed in the conveyance path after the second recording medium is to be fed to the conveyance path, based on the detected separation time;

a procedure (E) to perform control to feed the following first recording medium to the conveyance path based on the calculated first feed timing; and a procedure (F) to convey the second recording medium separated by the separating unit to a converging point in the conveyance path and to insert the second recording medium into the conveyance path with an inserting unit.

12. The insertion device according to claim 1, wherein the insertion request is a request for conveying the second recording medium from the loading unit.

13. The image forming system according to claim 3, wherein the insertion request is a request for conveying the second recording medium from the loading unit.

14. The image forming system according to claim 9, wherein the insertion request is a request for conveying the second recording medium from the loading unit.

15. The method according to claim 10, wherein the insertion request is a request for conveying the second recording medium from the loading unit.

16. The non-transitory recording medium according to claim 11, wherein the insertion request is a request for conveying the second recording medium from the loading unit.

* * * * *